US007704661B2

(12) United States Patent
Ikeda et al.

(10) Patent No.: US 7,704,661 B2
(45) Date of Patent: Apr. 27, 2010

(54) TONER AND IMAGE FORMING METHOD

(75) Inventors: Naotaka Ikeda, Suntou-gun (JP); Shinya Yachi, Mishima (JP); Katsuyuki Nonaka, Mishima (JP); Emi Watanabe, Suntou-gun (JP); Koji Abe, Numazu (JP); Nobuhisa Abe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/563,533

(22) Filed: Sep. 21, 2009

(65) Prior Publication Data

US 2010/0009278 A1 Jan. 14, 2010

Related U.S. Application Data

(63) Continuation of application No. PCT/JP2009/057012, filed on Mar. 30, 2009.

(30) Foreign Application Priority Data

Mar. 31, 2008 (JP) ..... 2008-091160

(51) Int. Cl.
*G03G 9/08* (2006.01)

(52) U.S. Cl. ..... 430/108.7; 430/108.1; 430/108.6

(58) Field of Classification Search ..... 430/108.1, 430/108.6, 108.7
See application file for complete search history.

(56) References Cited

U.S. PATENT DOCUMENTS 3,720,617 A 3/1973 Chatterji et al. ..... 252/62.1
7,014,969 B2 3/2006 Yachi et al. ..... 430/108.7

FOREIGN PATENT DOCUMENTS

| | | |
|---|---|---|
| JP | 49-042354 | 4/1974 |
| JP | 54-016219 | 6/1979 |
| JP | 55-120041 | 9/1980 |
| JP | 59-201063 | 11/1984 |

(Continued)

OTHER PUBLICATIONS

International Search Report issued in the corresponding International Application PCT/JP2009/057012 dated Jun. 30, 2009 (10 pages).

(Continued)

*Primary Examiner*—Mark F Huff
*Assistant Examiner*—Peter L Vajda
(74) *Attorney, Agent, or Firm*—Fitzpatrick, Cella, Harper & Scinto

(57) ABSTRACT

A toner is provided which has toner particles and a fine silica powder mixed by external addition to the toner particles. The toner has a weight average particle diameter of 4.0 to 9.0 μm. The fine silica powder is subjected to hydrophobic treatment with dimethylsilicone oil, and has, in particle size distribution based on volume, a peak at which cumulative frequency is largest, in the measurement range of 0.02 μm to 1,000.00 μm; the cumulative frequency of 0.10 μm to less than 1.00 μm being 7.0% or less, and, the fine silica powder fulfills the following conditions:

1) $A+B \geqq 93.0$;
2) $0.45 \leqq A/B \leqq 6.00$; and
3) the value of [(carbon content of the treated fine silica powder)/(BET specific surface area of fine silica powder before hydrophobic treatment)] is 0.030 or more to 0.055 or less.

10 Claims, 2 Drawing Sheets

FOREIGN PATENT DOCUMENTS

| | | |
|---|---|---|
| JP | 08-152742 | 6/1996 |
| JP | 2001-194819 | 7/2001 |
| JP | 2004-168559 | 6/2004 |
| JP | 2005-049649 | 2/2005 |
| JP | 2005-055733 | 3/2005 |

OTHER PUBLICATIONS

Patrial translation of JP-49-042354, filed Apr. 20, 1974 in Japan, 8 pages.

TONER AND IMAGE FORMING METHOD

CROSS-REFERENCE TO RELATED APPLICATIONS

This application is a continuation of International Application No. PCT/JP2009/057012, filed Mar. 30, 2009, which claims the benefit of Japanese Patent Application No. 2008-091160, filed Mar. 31, 2008.

BACKGROUND OF THE INVENTION

1. Field of the Invention

This invention relates to a toner having at least a fine silica powder, which is favorably usable when electrical latent images are formed and developed in electrophotography, electrostatic printing or toner jet recording; and an image forming method making use of the toner.

2. Description of the Related Art

Conventionally, electrophotography is a process in which a recorded image is obtained by forming an electrostatic latent image on a latent image bearing member (photosensitive member) by various means, subsequently developing the latent image by the use of a toner to form a toner image on the photosensitive member, transferring the toner image to a recording material by the use of a direct or indirect means as occasion calls, followed by fixing by the action of heat, pressure and/or light.

As developing systems, conventionally a one-component developing system and a two-component developing system are available. In either developing system, as printers, or copying machines, for business use or personal use which are operated by electrophotography, there is in recent years an increasing demand for making them smaller in size, higher in speed, longer in lifetime (making stable images obtainable over long-term use) and so forth.

As toners for electrophotography which are commonly used in both the one-component developing system and the two-component developing system, they use a surface-treated fine powder of silica, titanium oxide or alumina, having been subjected to hydrophobic treatment, for the purposes of providing the toners with fluidity and charge stability and making them less adherent to structural members.

A common one-component developing system is a system in which recorded images are obtained by bringing a toner carrying member on the surface of which a toner is coated in the form of a thin layer and an electrostatic latent image bearing member into contact with each other to render electrostatic latent images visible and further transferring and fixing the resultant visible images one after another onto a recording material. Here, the toner assumes any desired state of charging, where in such charging the toner is provided with charge by forming a thin layer of the toner on the toner carrying member surface by the aid of a layer thickness control member and simultaneously bringing the toner into friction with the toner carrying member surface and the control member surface. Further, the charge polarity of this toner is utilized to render the electrostatic latent images visible potentially by utilizing an electric field at a developing zone.

Hence, when the thin layer of the toner is formed on the toner carrying member surface by the control member, the toner and/or an external additive such as a fine silica powder tend(s) to come to melt-stick to the toner carrying member surface and control member surface because of pressure put by the control member. As the result, any toner layer disorder due to the matter having thus melt-stuck thereto may appear on images to tend to cause line marks (development line marks) on the images. Accordingly, a toner and/or an external additive such as a fine silica powder is/are desired which can not easily melt-stick to the toner carrying member surface and control member surface.

In the two-component developing system, the toner and/or the external additive such as a fine silica powder tend(s) to come to melt-stick to carrier particles as a result of long-term service. As the result, such matter having melt-stuck thereto tends to cause a lowering of charge-providing ability of the carrier to the toner, so that in some cases the charge quantity of toner can not stabilize to make image density unstable or cause fog seriously and make it unable to obtain stable images over a long period of time. Accordingly, a toner and/or an external additive such as a fine silica powder is/are desired which can not easily melt-stick to the carrier particles.

Meanwhile, as conventional fine silica powders, fine silica powders the particle surfaces of which have been subjected to hydrophobic treatment are known in the art (see, e.g., Japanese Patent Publication No. S54-016219 and Japanese Patent Laid-open Applications No. S59-201063 and No. S55-120041). These hydrophobic fine silica powders are those having been treated with dimethyldichlorosilane or hexamethyldisilazane, and can not be said to be sufficiently hydrophobic, thus, in a severe high-temperature and high-humidity environment, these may cause a lowering of charge quantity because of moisture absorption. As the result, a problem tends to come about such that, as a result of long-term service, image density becomes unstable or fog occurs seriously.

A method is also disclosed in which a fine silica powder is treated with silicone oil and used in a toner (see, e.g., Japanese Patent Laid-open Application No. S49-42354). This method can ensure hydrophobicity to a certain degree. However, since the silicone oil is a high-molecular substance, agglomeration takes place when the fine silica powder is treated with the silicone oil, to produce agglomerates of about 200 μm in size or produce powder lumps of various sizes upon further mutual agglomeration of such agglomerates. As the result, the toner may have a poor fluidity to tend to cause fog.

Such a surface-treated fine silica powder has an average primary particle diameter of approximately from a few nm to tens of nm, whereas the fine silica powder is, as a state before mixing by its external addition to toner particles, present in the form of about 200-μm agglomerates of primary particles, or powder lumps formed upon further mutual agglomeration of such agglomerates. In particular, the fine silica powder treated with what is of a silicone oil type is so strongly agglomerative between primary particles or agglomerates as to have a tendency to easily melt-stick to the toner carrying member and control member or to the carrier particles, and so forth.

Accordingly, in order to stabilize surface treatment performance, a method is proposed in which, aiming to keep particles from agglomerating to have low fluidity or dispersibility when a treating agent is used in a large quantity, the surface-treated fine silica powder is used after it has been disintegrated (see, e.g., Japanese Patent Laid-open Applications No. H08-152742 and No. 2004-168559).

For example, in the above Japanese Patent Laid-open Application No. H08-152742, it is disclosed that a surface-treated fine powder is used after it has been disintegrated by means of a jet mill. However, such a powder subjected to disintegration treatment has a portion remaining untreated, and hence, though it is temporarily made fine, has a problem that it may again agglomerate with lapse of time. As the result, in long-term service, the fine silica powder tends to come liberated from toner, where the fine silica powder having come liberated therefrom tends to adhere or melt-stick to the toner carrying member and control member in the case of the one-component developing system, or to carrier particles in the case of the two-component developing system, tending to cause difficulties in images.

For another example, in the above Japanese Patent Laid-open Application No. 2004-168559, a fine silica powder is disclosed which has been subjected to disintegration treatment until its agglomerates come very fine, so as to have particle size distribution in a specific range. However, where the powder subjected to disintegration treatment in this way is mixed in the toner by external addition, the fine silica powder tends to come buried in toner particles during long-term service because the agglomerates have been too finely disintegrated. As the result, as a toner, it tends to become greatly low in fluidity to become poor in transfer performance, or the charge quantity of toner tends not to stabilize to make image density unstable or cause fog seriously.

Thus, it has been difficult to make the charge quantity of toner stabilize in every environment and also to keep the toner and/or the fine silica powder from melt-sticking to the toner carrying member and control member or to the carrier particles.

SUMMARY OF THE INVENTION

The present invention is to provide a toner having resolved the above problems, and an image forming method making use of such a toner.

An object of the present invention is to provide a toner, and an image forming method, which promise a superior transfer performance, have kept any fog from occurring and promise superior running stability, even in printing performed on a large number of sheets (i.e., even in long-term service).

Another object of the present invention is to provide a toner, and an image forming method, which, when used in the one-component developing system, may less cause melt-sticking of the toner and/or the fine silica powder to the toner carrying member and control member, promise sharp image characteristics free of any development line marks or the like and also promise superior running stability, even in printing performed on a large number of sheets.

Still another object of the present invention is to provide a toner, and an image forming method, which, when used in the two-component developing system, may less cause adhesion of the toner or the fine silica powder to the carrier particles, promise sharp image characteristics free of any fog or the like and also promise superior running stability, even in printing performed on a large number of sheets.

The present inventors have, as a result of extensive studies, discovered that the use of the following toner and image forming method satisfy the above requirements, and have come up with the present invention.

That is, they have discovered that the above requirements can be satisfied by a toner comprising toner particles and at least a fine silica powder having been mixed by external addition to the toner particles, and an image forming method making use of the toner;

the toner having a weight average particle diameter of from 4.0 μm or more to 9.0 μm or less, and;

the fine silica powder having been subjected to hydrophobic treatment with dimethylsilicone oil at least, and having, in particle size distribution based on volume of the fine silica powder as measured with a laser diffraction particle size distribution meter, a peak at which cumulative frequency is largest, in at least the measurement range of from 0.02 μm or more to 1,000.00 μm or less; the cumulative frequency of from 0.10 μm or more to less than 1.00 μm being 7.0% or less, and, where the cumulative frequency of from 10.10 μm or more to less than 39.23 μm is represented by A(%) and the cumulative frequency of from 39.23 μm or more to less than 200.00 μm is represented by B(%), the fine silica powder fulfilling the following conditions 1) to 3):

1) $A+B \geqq 93.0$;

2) $0.45 \leqq A/B \leqq 6.00$; and 3) the value of [(carbon content of the treated fine silica powder)/(BET specific surface area of fine silica powder before hydrophobic treatment)] is from 0.030 or more to 0.055 or less.

Thus, they have come up with the present invention.

In the toner and image forming method of the present invention, the fine silica powder mixed in the toner by external addition has been surface-treated (hydrophobic-treated) with an appropriate amount of dimethylsilicone oil and also has an appropriate particle size distribution, and therefore, in long-term service, the fine silica powder is kept from coming liberated from the toner and/or from coming buried in toner particles. Hence, stable image density stability and image quality can be achieved over a long period of time.

In the one-component developing system, when the thin layer of the toner is formed on the toner carrying member surface by the control member, the toner and/or the fine silica powder can be kept from melt-sticking to the toner carrying member and control member. Thus, stable image density stability and image quality can be achieved over a long period of time.

In the two-component developing system, the toner and/or the fine silica powder can be kept from melt-sticking to carrier particles, and the charge-providing ability of the carrier to the toner stabilizes over a long period of time. Thus, the image density stabilizes, and image quality can be achieved with less fog and with good running stability.

Further, since in long-term service the fine silica powder is kept from coming liberated from the toner and/or from coming buried in toner particles, stable fluidity and chargeability of the toner can be maintained over a long period of time, and image quality can be achieved with a good transfer performance In respect of a toner having at least a fine silica powder and an image forming method making use of the toner which are used in the one-component developing system and two-component developing system, the present inventors have made extensive studies on the level of surface treatment of fine silica powder with silicone oil and the particle size distribution of the fine silica powder. As the result, they have discovered the toner and image forming method that can resolve the problems discussed previously, and have come to accomplish the present invention.

Further features of the present invention will become apparent from the following description of exemplary embodiments with reference to the attached drawings.

DESCRIPTION OF THE EMBODIMENTS

Figure 1:
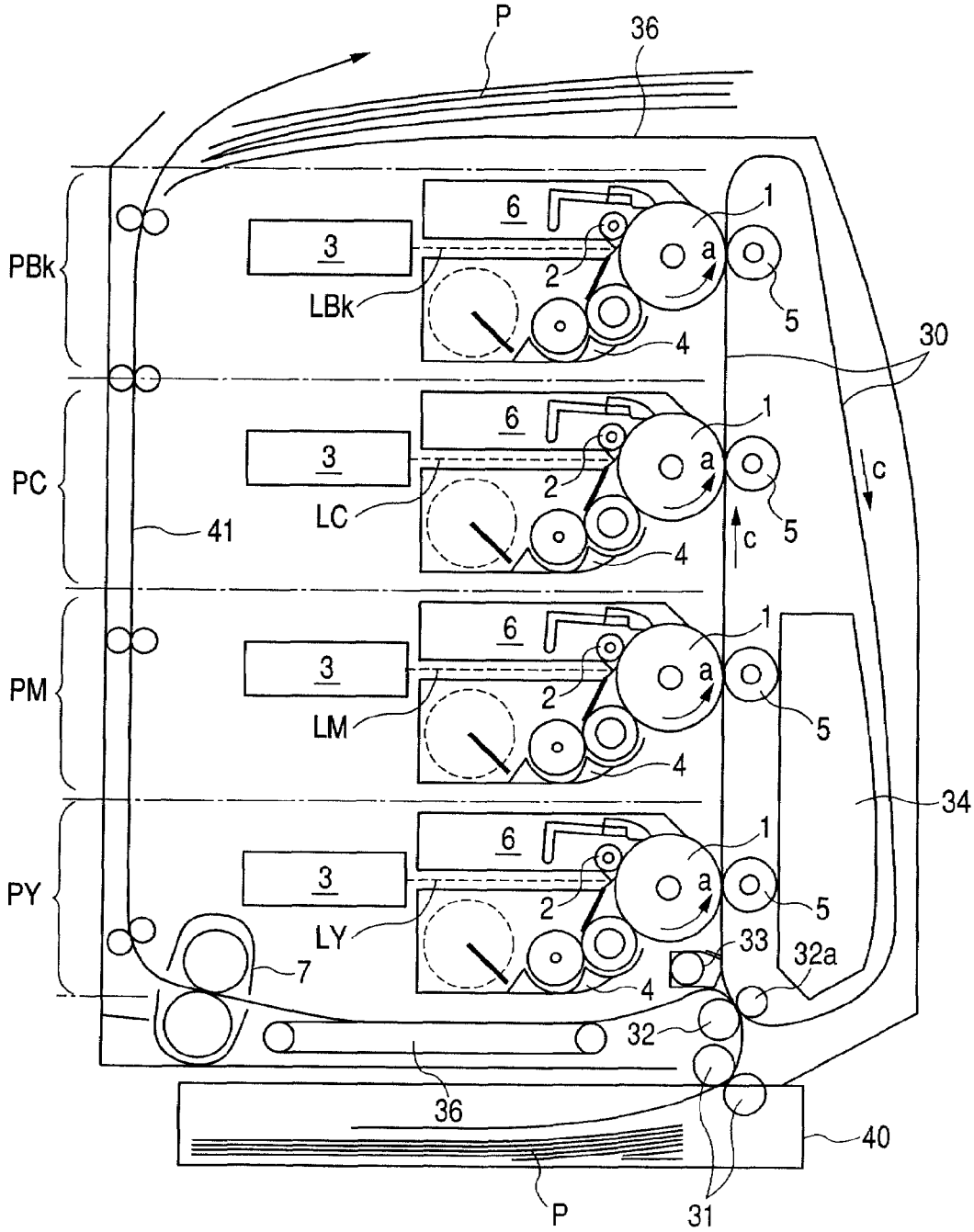
FIG. 1 is an illustration of an image forming apparatus making use of the toner of the present invention.

Preferred embodiments of the present invention will now be described in detail in accordance with the accompanying drawings.

In the present invention, the fine silica powder mixed in the toner by external addition has been controlled on its particle size distribution and surface treatment level.

An untreated fine silica powder, standing before the hydrophobic treatment carried out in the present invention, may be what is called dry-process fine silica powder called dry-process silica or fumed silica, produced by vapor phase oxidation of a silicon halide, or what is called wet-process fine silica powder, produced from water glass or the like, either of which may be used.

In particular, fumed silica is preferred, which can highly maintain its fluidity-providing properties.

The fine silica powder used in the present invention may be obtained by controlling the level of surface treatment with silicone oil and carrying out surface treatment and disintegration treatment so as to have the desired particle size distribution, which are described below in detail. The disintegration treatment may be carried out before and/or after the surface treatment with silicone oil, or may be carried out simultaneously with the surface treatment. In particular, the disintegration treatment may be carried out after the surface treatment has been carried out, and this is preferred in view of an advantage that the fine silica powder can be kept from again agglomerating.

The fine silica powder used in the present invention may also be one having been subjected to not only the surface treatment with silicone oil, but also surface treatment such as dry-process treatment or wet-process treatment, with the other surface-treating agent, e.g., a silylating agent. However, where the treatment with silicone oil and the treatment with any other hydrophobic-treating agent are different in order, or the amount of the treating agent used or the method of treatment is not appropriate, there may be a case in which any wettability can not be achieved, the wettability as a preferred embodiment as the fine silica powder in the present invention, which is described later.

In the present invention, as the silicone oil used in the hydrophobic treatment of the untreated fine silica powder, dimethylsilicone oil is used so that the toner may be less influenced by humidity.

In addition to the dimethylsilicone oil, any known silicone oil may also optionally be mixed according to purposes, which is specifically exemplified by straight silicone oils such as methyl phenyl silicone oil and methyl hydrogen silicone oil; and modified silicone oils such as amino modified silicone oil, epoxy modified silicone oil, carboxyl modified silicone oil, carbinol modified silicone oil, methacrylic modified silicone oil, mercapto modified silicone oil, phenol modified silicone oil, one-terminal reactive modified silicone oil, heterofunctional-group modified silicone oil, polyether modified silicone oil, methyl styryl modified silicone oil, alkyl modified silicone oil, higher fatty ester modified silicone oil, hydrophilic specialty modified silicone oil, higher-alkoxyl modified silicone oil, higher fatty acid-containing modified silicone oil and fluorine modified silicone oil. In particular, it is preferable to select any from the straight silicone oils.

As the other surface-treating agent, any known agent may be used without any limitations.

For example, as a silylating agent, it may include trichlorosilanes such as methyltrichlorosilane, dimethyldichlorosilane, trimethylchlorosilane, phenyltrichlorosilane, t-butyldimethylchlorosilane, dimethyldichlorosilane and vinyltrichlorosilane; alkoxysilanes such as tetramethoxysilane, methyltrimethoxysilane, dimethyldimethoxysilane, phenyltrimethoxysilane, diphenyldimethoxysilane, O-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyltriethoxysilane, phenyltrimethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane and γ-(2-aminoethyl) aminopropyldimethoxysilane; and silazanes such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane and dimethyltetravinyldisilazane.

Further, as a fatty acid and a metal salt thereof, they may include long-chain fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linolic acid and arachidonic acid, and as the metal salt thereof, may include salts with metals such as zinc, iron, magnesium, aluminum, calcium, sodium and lithium, which are also effective as surface-treating agents (hydrophobic-treating agents).

The surface treatment of untreated fine silica powder may be carried out by, e.g., a method in which the untreated fine silica powder is treated with a hydrophobic-treating agent by a dry process, or a method in which the untreated fine silica powder is immersed in a solvent such as water or an organic compound to treat it with a hydrophobic-treating agent by a wet process, without any particular limitations on treating methods, and may be carried out by any known method without any problem.

As a specific procedure for the surface treatment, for example the untreated fine silica powder is added to a solvent in which the dimethylsilicone oil has been dissolved, to allow them to react, thereafter the solvent is removed, and then the disintegration treatment is carried out. The following method may also be used. For example, the untreated fine silica powder is put into a reaction tank, then, in an atmosphere of nitrogen, alcohol water is added thereto with stirring, and the dimethylsilicone oil is introduced into the reaction tank to carry out surface treatment, followed by further stirring with heating to remove the solvent, and then cooling.

Where the untreated fine silica powder is surface-treated with an alkylsilazane or the like and thereafter surface-treated with the dimethylsilicone oil, for example the untreated fine silica powder is added to a solvent in which the alkylsilazane has been dissolved, to allow them to react, and then the solvent is removed, followed by cooling. Thereafter, this fine silica powder is added to a solvent in which the dimethylsilicone oil has been dissolved (the pH of which solvent may preferably be adjusted to 4 with an organic acid or the like), to allow them to react, thereafter the solvent is removed, and then the disintegration treatment is carried out. The following method may also be used. For example, the untreated fine silica powder is put into a reaction tank, and, in an atmosphere of nitrogen, the alkylsilazane is introduced thereinto with stirring to carry out surface treatment, followed by further stirring with heating to remove the solvent, and then cooling. Thereafter, in an atmosphere of nitrogen, alcohol water is added to the above with stirring, and the dimethylsilicone oil is introduced into the reaction tank to carry out surface treatment, followed by further stirring with heating to remove the solvent, and then cooling.

Treatment conditions are so controlled that the fine silica powder may have the surface treatment level, particle size distribution, and wettability as a preferred embodiment that are described below.

As the level of treatment with the dimethylsilicone oil on the untreated fine silica powder, carbon content of the fine silica powder having been surface-treated with the dimethylsilicone oil with respect to specific surface area of the untreated fine silica powder is so controlled as to be in the following range.

The value of [(carbon content of treated fine silica powder)/(BET specific surface area of fine silica powder before hydrophobic treatment)] (hereinafter simply "C content/BET" in some cases) is from 0.030 or more to 0.055 or less, and may preferably be from 0.035 or more to 0.050 or less. The unit of the carbon content is % by mass, and the unit of the BET specific surface area is $m^2/g$. Here, the carbon content of treated fine silica powder refers to carbon content coming from the fine silica powder, and a method for its measurement is shown below.

Measurement of Carbon Content

The carbon contained in surface hydrophobic groups of the fine silica powder having been treated with the fine silica powder is thermally decomposed into $CO_2$ at 1,100° C. in an atmosphere of oxygen, and thereafter the carbon content the treated fine silica powder contains is determined by using a carbon microanalyzer (EMIA-110, manufactured by Horiba Ltd.). However, the carbon content of any treating agent other than the dimethylsilicone oil shall be excluded. For example, where the dimethylsilicone oil and the other silicone oil are used in combination, one making use of only the dimethylsilicone oil is prepared under the like conditions, and its carbon content is taken as the "carbon content of treated fine silica powder". For another example, in the case of fine silica powder having been surface-treated with a silane coupling agent and thereafter surface-treated with the dimethylsilicone oil, the carbon content of fine silica powder treated up to silane coupling treatment is subtracted from the carbon content of the fine silica powder having been surface-treated with the silane coupling agent and up to dimethylsilicone oil, and the value of carbon content thus found is taken as the "carbon content of treated fine silica powder".

Measurement of BET Specific Surface Area of Fine Silica Powder

The BET specific surface area is measured with known instruments such as a degassing unit VacPrep 061 (manufactured by Micromeritics Instrument Incorporation) and a BET measuring instrument GEMINI 2375 (manufactured by Micromeritics Instrument Incorporation). The BET specific surface area in the present invention is the value of multiple point method BET specific surface area. Stated specifically, it is measured by the procedure as shown below.

The mass of an empty sample cell is measured, and thereafter the sample cell is so supplied with a measuring sample as to hold it in an amount of approximately from 1.0 g to 2.0 g. The sample cell thus supplied with the sample (fine silica powder before surface treatment) is set in the degassing unit to carry out degassing at room temperature for 3 hours. After the degassing is completed, the whole mass of the sample cell is measured. From its difference from the mass of the empty sample, an accurate mass of the sample is calculated. Next, empty samples are set at a balance port and an analysis port of the BET measuring instrument. A Dewar vessel holding liquid nitrogen therein is set at a stated position, and saturated vapor pressure (P0) is measured according to a saturated vapor pressure (P0) measurement command. After the P0 measurement is completed, the sample cell prepared by degassing is set at the analysis port. After the sample mass and the P0 are inputted, the measurement is started according to a BET measurement command. Then, the BET specific surface area is automatically calculated.

As long as the value of C content/BET is in the above range, the level of treatment with silicone oil in the fine silica powder is appropriate. Thus, the fluidity of the toner can well be maintained over a long period of time, fog or the like can be kept from occurring, and also the fine silica powder can well be kept from adhering to the toner carrying member and control member or to the carrier particles.

The fine silica powder according to the present invention may preferably be one having a primary-particle number average length of from 5 nm or more to 200 nm or less, and much preferably from 7 nm or more to 100 nm or less.

Herein, to measure the average length of primary particles of the fine silica powder, a photograph of toner particle surfaces is taken which are magnified 500,000 times on a scanning electron microscope FE-SEM (S-4700, manufactured by Hitachi Ltd.), and this photograph of magnified particles is used as a measuring object.

Lengths of primary particles are measured over 10 visual fields in the photograph of magnified particles, and an average is taken as the average length. Here, among parallel lines which are so drawn as to come into touch with the contours of each primary particle of the fine silica powder, what is largest in distance between such parallel lines is taken as the length of each primary particle.

The fine silica powder may also change in the degree of water adsorption or the extent of charging sites, depending on the specific surface area measured by the BET method, and hence it is preferable to control this.

The fine silica powder (after hydrophobic treatment) in the present invention may preferably have a BET specific surface area of from 35 $m^2/g$ or more to 350 $m^2/g$ or less, and much preferably from 75 $m^2/g$ or more to 250 $m^2/g$ or less. As long as it has BET specific surface area in the above range, it can well be kept from coming liberated from the toner or forming agglomerates.

As the degree of surface treatment on the fine silica powder, the fine silica powder in the present invention may also preferably have, in addition to the C content/BET, a wettability to a methanol/water mixed solvent, of from 70% by volume or more to 75% by volume or less. As long as it has wettability in the above range, the toner can have a sufficient fluidity without regard to environments to enable fog or the like to be well kept from occurring and also enable stable image density to be maintained even in long-term service.

Measurement of Wettability

The wettability in the present invention is measured with a powder wettability measuring instrument WET-100P (manufactured by Rhesca Company, Limited).

Assuming as 100% the transmittance of light of pure water at 780 nm in wavelength, the wettability is measured in the following way.

0.20 g (0.20±0.01 g) of the fine silica powder is weighed out, and then added to 50 ml of pure water, where, with stirring by means of a magnetic stirrer (300 rpm), methanol is poured beneath liquid surface (flow rate: 2.5 ml/5 minutes) in the state the fine silica powder floats on the liquid surface. Then, when the fine silica powder has come dispersed as silica in the methanol/water mixed solvent, methanol concentration (% by volume) at a point of time where the transmittance of light at 780 nm in wavelength has come to 50% is regarded as the wettability.

The fine silica powder used in the present invention, standing before its external addition to the toner particles, has the following particle size distribution. Such particle size distribution is achieved by forming composite particles in which a plurality of primary particles of fine silica powder having primary particle diameter have coalesced. Such composite particles are made present so as to achieve the particle size distribution specified in the present invention. This enables the fine silica powder to be kept from coming liberated from toner particles and from coming buried in toner particles, and enables the toner and/or the fine silica powder to be kept from melt-sticking to the toner carrying member and control member or to the carrier particles. Further, the fine silica powder can have an effect as spacer particles to make an improvement in transfer performance and make prevention of toner deterioration well achievable.

In the present invention, conditions for disintegration treatment of the fine silica powder are controlled so as to make the fine silica powder have the following particle size distribution.

The fine silica powder used in the present invention has, in its particle size distribution based on volume as measured with a laser diffraction particle size distribution meter, a peak at which cumulative frequency is largest, in at least the measurement range of from 0.02 μm or more to 1,000.00 μm or less; the cumulative frequency of from 0.10 μm or more to less than 1.00 μm being 7.0% or less, preferably 5.0% or less, and more preferably 3.0% or less, and, where the cumulative frequency of from 10.10 μm or more to less than 39.23 μm is represented by A(%) and the cumulative frequency of from 39.23 μm or more to less than 200.00 μm is represented by B(%), the fine silica powder fulfilling the following conditions 1) and 2):

1) $A+B \geqq 93.0$; and

2) $0.45 \leqq A/B \leqq 6.00$, preferably $0.50 \leqq A/B \leqq 3.50$, and much preferably $0.52 \leqq A/B \leqq 2.00$.

How to Measure Particle Size Distribution of Fine Silica Powder

The particle size distribution based on volume of the fine silica powder used in the present invention is measured according to JIS Z 8825-1 (2001), which is, stated specifically, as follows:

As a measuring instrument, a laser diffraction-scattering particle size distribution measuring instrument "LA-920" (manufactured by Horiba Ltd.) is used. Measuring conditions are set and measured data are analyzed both using a software "HORIBA LA-920 for Windows (registered trademark) WET (LA-920) Ver. 2.02" attached to LA-920 for its exclusive use. As a measuring solvent, ethanol is used.

Measurement is made using a flow cell and by a circulation system. Various conditions for measurement are as follows:

Ultrasonic wave: Level 3.

Circulation speed: Level 3.

Relative refractive index: 1.08.

Measurement procedure is as follows.

The ethanol is circulated, where about 1 mg (the amount that affords a transmittance of 70% to 95%) is added thereto little by little, and dispersed therein. Then, ultrasonic dispersion treatment is further carried out for 60 seconds. In carrying out the ultrasonic dispersion, the water temperature in the water tank is appropriately so controlled as to be from 10° C. or more to 40° C. or less.

Thereafter, the particle size distribution is measured. Here, in the laser diffraction-scattering particle size distribution measuring instrument "LA-920", particle diameters of individual particles are determined, and are first apportioned to channels shown in Table 1. Then, the central diameter in each channel is taken as a representative of that channel. A sphere is assumed which has this representative as diameter, and the particle size distribution based on volume is determined on the basis of the volume of such a sphere.

TABLE 1

| Particle diameter (μm) |
|---|
| 0.022 |
| 0.026 |
| 0.029 |
| 0.034 |
| 0.039 |
| 0.044 |
| 0.051 |
| 0.058 |
| 0.067 |
| 0.076 |
| 0.087 |
| 0.1 |
| 0.115 |
| 0.131 |
| 0.15 |
| 0.172 |
| 0.197 |
| 0.226 |
| 0.259 |
| 0.296 |
| 0.339 |
| 0.389 |
| 0.445 |
| 0.51 |
| 0.584 |
| 0.669 |
| 0.766 |
| 0.0877 |
| 1.005 |
| 1.151 |
| 1.318 |
| 1.51 |
| 1.729 |
| 1.981 |
| 2.269 |
| 2.599 |
| 2.976 |
| 3.409 |
| 3.905 |
| 4.472 |
| 5.122 |
| 5.867 |
| 6.72 |
| 7.697 |
| 8.816 |
| 10.097 |
| 11.565 |
| 13.426 |
| 15.172 |
| 17.377 |
| 19.904 |
| 22.797 |
| 26.111 |
| 29.907 |
| 34.255 |
| 39.234 |
| 44.938 |
| 51.471 |

TABLE 1-continued

| Particle diameter (μm) |
|---|
| 58.953 |
| 67.523 |
| 77.339 |
| 88.583 |
| 101.46 |
| 116.21 |
| 133.103 |
| 152.453 |
| 174.616 |
| Likewise follows up to 1,000.000 |

On the basis of the data of particle size distribution based on volume thus obtained, the cumulative frequency (%) of from 0.10 μm or more to less than 1.00 μm, the cumulative frequency of from 10.10 μm or more to less than 39.23 μm and the cumulative frequency of from 39.23 μm or more to less than 200.00 μm are calculated.

Where the value of A+B of the fine silica powder used in the toner of the present invention is less than 93.0%, it means that the cumulative frequency of less than 10.10 μm and that of 200 μm or more are large. For example, if the cumulative frequency of 200 μm or more is large, the fine silica powder may come much liberated from the toner, so that the fine silica powder may tend to adhere or melt-stick to the toner carrying member and control member or to the carrier particles. If on the other hand the cumulative frequency of less than 10 μm is large, the fine silica powder tends to come buried in toner particles during long-term service, to make it unable in some cases to maintain the fluidity of the toner over a long period of time. This problem is remarkable especially where the cumulative frequency (%) of from 0.10 μm or more to less than 1.00 μm is larger than 7.0%.

If the value of A/B of the fine silica powder used in the toner of the present invention is less than 0.45, i.e., where disintegration treatment is insufficient, the fine silica powder standing agglomerate is so much that the fine silica powder may tend to adhere or melt-stick to the toner carrying member and control member or to the carrier particles. If the value of A/B is larger than 6.00, the fine silica powder tends to come buried in toner particles during long-term service, to make it unable to maintain the fluidity of the toner over a long period of time, and cause fog seriously or result in poor transfer performance in some cases. Also, the fine silica powder tends to agglomerate electrostatically and tends to again agglomerate with time, where the fine silica powder may come much liberated from the toner, so that the fine silica powder may tend to melt-stick to the toner carrying member and control member or to the carrier particles.

In addition to the above particle size distribution, it is also preferable that cumulative frequency of from 77.34 μm or more to less than 200.00 μm is 2.5% or more. If it is less than 2.5%, the fine silica powder tends to come buried in toner particles during long-term service, to make it unable to maintain the fluidity of the toner over a long period of time, and cause fog seriously or result in poor transfer performance in some cases. Also, the fine silica powder tends to again agglomerate with time, where the fine silica powder may come much liberated from the toner, so that the fine silica powder may tend to adhere or melt-stick to the toner carrying member and control member or to the carrier particles.

As a method for the disintegration treatment to obtain the fine silica powder having the above particle size distribution in the present invention, any known disintegrating machine may be used. For example, a method is available in which the surface-treated fine silica powder is disintegrated by means of a high-speed impact type fine grinding machine Pulverizer (manufactured by Hosokawa Micron Corporation), into a composite having the above particle size distribution.

In the present invention, when the fine silica powder is externally added to toner particles, it may preferably be added in an amount of from 0.05 part by mass to 3.00 parts by mass based on 100 parts by mass of the toner particles.

As long as the fine silica powder is added in the amount within the above range, it can well exhibit its effect as a spacer, so that the toner can have better transfer performance and developing performance. Also, the fine silica powder can be kept from coming liberated from the toner, to make the toner improved in fluidity, and hence the toner can be kept from melt-sticking to the toner carrying member and control member or to the carrier particles.

The toner of the present invention is described further.

The toner according to the present invention comprises toner particles containing at least a binder resin and a colorant, and the fine silica powder as an external additive. The toner according to the present invention has a weight average particle diameter (D4) of from 4.0 μm or more to 9.0 μm or less.

If the toner has a weight average particle diameter of more than 9.0 μm, the toner which develops electrostatic latent images are so large in particle diameter that development faithful to the electrostatic latent images can not easily be performed and also the toner may tend to scatter when electrostatic transfer is performed. If on the other hand the toner has a weight average particle diameter of less than 4.0 μm, it may be unable to make the toner have the desired fluidity over a long period of time, even though it is a toner having the fine silica powder of the present invention, so that the toner may tend to melt-stick to the toner carrying member and control member or to the carrier particles. In addition, the toner may have non-electrostatic adhesive force so strongly as to have a strong force of adhesion to a transfer member such as an intermediate transfer member, resulting in a poor transfer performance.

To measure the particle diameter of the toner, for example a method is available which makes use of Coulter counter.

As the binder resin used for the toner particles, any of resins exemplified below may be used. For example, usable are homopolymers of styrene or its derivatives, such as polystyrene, poly-p-chlorostyrene and polyvinyltoluene; styrene copolymers such as a styrene-p-chlorostyrene copolymer, a styrene-vinyltoluene copolymer, a styrene-vinylnaphthalene copolymer, styrene-acrylate copolymers, styrene-methacrylate copolymers, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride; phenolic resins; natural modified phenolic resins; natural-resin modified maleic resins; acrylic resins; methacrylic resins; polyvinyl acetate resin; silicone resins; polyester resins; polyurethane; polyamide resins; furan resins; epoxy resins; xylene resins; polyvinyl butyral; terpene resins; coumarone indene resins; hybrid resin having a polyester unit and a vinyl polymer unit; a mixture of hybrid resin and vinyl polymer; a mixture of hybrid resin and polyester resin; a mixture of polyester resin and vinyl polymer; and petroleum resins.

As a preferred binder resin, though there are no particular limitations, a resin is preferred which is selected from any of styrene copolymers, polyester resins, hybrid resin having a polyester unit and a vinyl polymer unit, a mixture of hybrid resin and vinyl polymer, a mixture of hybrid resin and polyester resin, and a mixture of polyester resin and vinyl polymer.

A cross-linked styrene resin is also a preferred binder resin.

The styrene polymers or styrene copolymers may also be cross-linked, and further a resin having been cross-linked and a resin having not been cross-linked may be mixed.

As a cross-linking agent for the binder resin, a compound may be used which chiefly has two or more polymerizable double bonds. It may include, e.g., aromatic divinyl compounds such as divinylbenzene and divinylnaphthalene; carboxylates having two double bonds, such as ethylene glycol diacrylate, ethylene glycol dimethacrylate and 1,3-butanediol dimethacrylate; divinyl compounds such as divinylaniline, divinyl ether, divinyl sulfide and divinyl sulfone; and compounds having three or more vinyl groups. Any of these may be used alone or in the form of a mixture.

In the present invention, besides the above binder resin, a polar resin having a carboxyl group, such as a polyester resin or a polycarbonate resin, may be used in combination as a binder resin.

For example, where the toner particles are directly produced by suspension polymerization, the polar resin may be added at any time of polymerization reaction of from the step of dispersion up to the step of polymerization, whereby the state of presence of the polar resin can be so controlled that, according to a balance between a polymerizable monomer composition which is to make the toner particles and a polarity on which an aqueous dispersion medium is to take, the polar resin added may form thin layers on the surfaces of the toner particles or may come present with a gradient from surfaces toward centers of the toner particles. That is, the addition of the polar resin can strengthen shells of a core-shell structure.

The polar resin may preferably be added in an amount of from 1 part by mass or more to 25 parts by mass or less, and much preferably from 2 parts by mass or more to 15 parts by mass or less, based on 100 parts by mass of the binder resin. As long as its amount is in this range, the state of presence of the polar resin in the toner particles can be made uniform in an appropriate layer thickness.

The polar resin used in the present invention may include polyester resins, epoxy resins, a styrene-acrylic acid copolymer, a styrene-methacrylic acid copolymer and a styrene-maleic acid copolymer. In particular, as the polar resin, a polyester resin having a main peak molecular weight in the range of molecular weight of from 3,000 or more to 10,000 or less is preferred as enabling the toner particles to be improved in fluidity and negative triboelectric charge characteristics.

The toner particles may contain a charge control agent.

Those capable of controlling the toner particles to be negatively chargeable may include the following materials. For example, organometallic complexes or chelate compounds are effective, and further, monoazo metal compounds, acetylacetone metal compounds, and aromatic hydroxycarboxylic acid or aromatic dicarboxylic acid type metal compounds may preferably be used. They may further include aromatic hydroxycarboxylic acids, aromatic mono- or polycarboxylic acids, and metal salts of these, anhydrides of these, esters of these, and phenol derivatives of these such as bisphenol derivatives; urea derivatives; metal-containing salicylic acid type compounds; metal-containing naphthoic acid compounds; boron compounds; quaternary ammonium salts; carixarene; silicon compounds; a styrene-acrylic acid copolymer; a styrene-methacrylic acid copolymer; a styrene-acrylic-sulfonic acid copolymer; and non-metal carboxylic acid type compounds.

Those capable of controlling the toner particles to be positively chargeable may include the following materials. For example, amino compounds, quaternary ammonium salts, and organic dyes, in particular, basic dyes and salts thereof are known, which may include benzyldimethyl-hexadecylammonium chloride, decyl-trimethylammonium chloride, Nigrosine bases, Nigrosine hydrochloride, Safranine T and Crystal Violet. These dyes may also be used as colorants.

Any of these charge control agents may be used alone or in combination of two or more types.

The toner particles may contain a magnetic material. The magnetic material may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these. Any of the magnetic materials may also serve as a colorant.

The colorant for the toner particles used in the present invention is described next.

As black colorants, usable are carbon black, magnetic materials, and colorants toned in black by using yellow, magenta and cyan colorants shown below.

As yellow colorants, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147, 168 or 180 may preferably be used. A dye such as C.I. Solvent Yellow 93, 162 or 163 may also be used in combination.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 or 254 may preferably be used.

As cyan colorants, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 or 66 may particularly preferably be used.

Any of these colorants may be used alone, in the form of a mixture, or further in the state of a solid solution. In the present invention, the colorants are selected taking account of hue angle, chroma, brightness, weatherability, transparency on OHP sheets and dispersibility in toner particles.

The toner particles according to the present invention may also contain wax as a release agent, and this is a preferred embodiment. Where the toner particles contain the wax, especially where the wax is present on the surfaces of toner particles, the toner tends to melt-stick to the toner carrying member and control member or to the carrier particles. Hence, in such a toner having the wax in toner particles, the use of the fine silica powder used in the present invention enables the toner to be kept from melt-sticking to the toner carrying member and control member or to the carrier particles, and can sufficiently bring out its effect. Thus, this is one of preferred embodiments.

The wax may preferably be contained in the toner particles in an amount of from 1 part by mass to 20 parts by mass, and much preferably from 2 parts by mass to 17 parts by mass, based on 100 parts by mass of the binder resin.

Where the toner is produced by a pulverization process in which a mixture having the binder resin, the colorant and the wax is melt-kneaded, followed by cooling, pulverization and then classification to obtain toner particles, the wax may preferably be added in an amount of from 1 part by mass to 10 parts by mass, and much preferably from 2 parts by mass to 7 parts by mass, based on 100 parts by mass of the binder resin.

Where the toner is produced by a polymerization process in which a mixture having a polymerizable monomer, the colorant and the wax is polymerized, the wax may preferably be added in an amount of from 2 parts by mass to 20 parts by mass, and much preferably from 5 parts by mass to 17 parts by mass, based on 100 parts by mass of the polymerizable monomer, or the binder resin synthesized by the polymerization of the polymerizable monomer.

Usually, the wax has a lower polarity than the binder resin, and hence, in the polymerization process which carries out the polymerization in an aqueous medium, the wax can easily be enclosed in the interiors of toner particles in a large quantity. Hence, this enables use of the wax in a larger quantity than that in the pulverization process. Thus, in the case when the toner is produced by the polymerization process, it can have a better anti-offset effect.

Inasmuch as the mixing quantity of the wax is in the above range, the external additive can well be kept from coming liberated from the toner and from coming buried in toner particles.

Methods for producing the toner particles used in the present invention are described below. The toner particles used in the present invention may be produced by either of known pulverization and polymerization processes.

In the process for producing toner particles by pulverization, the binder resin, the wax, the pigment, dye or magnetic material as the colorant, and optionally the charge control agent and other additives are thoroughly mixed by means of a mixing machine such as Henschel mixer or a ball mill, and then the mixture obtained is melt-kneaded by using a heat kneading machine such as a heating roll, a kneader or an extruder to make the resin components melt one another, in which the metallic compound and the pigment, dye or magnetic material are dispersed or dissolved, and the kneaded product obtained is cooled to solidify, followed by pulverization and classification to obtain the toner particles.

The toner of the present invention may preferably have an average circularity R of $0.960 \leqq R \leqq 0.995$ as measured with a flow type particle image analyzer, for the purpose of making the toner less adherent to the toner carrying member and control member or to the carrier particles or more improved in transfer performance.

Hence, for the toner particles obtained by the above process for producing pulverization toner particles, it is preferable that the particles are made spherical and surface-modified.

As methods by which the toner particles are made spherical and surface-modified, known methods may be used, such as a method making use of a surface modifying apparatus (e.g., Japanese Patent Application Laid-open No. 2004-326075), a method done by hot air (e.g., Japanese Patent Application Laid-open No. 2000-029241) and a method done by a mechanical impact force (Japanese Patent Application Laid-open No. H07-181732).

In the process for producing polymerization toner particles, the toner particles may be produced by the method disclosed in Japanese Patent Publication No. S56-13945, in which a molten mixture is atomized in the air by means of a disk or multiple fluid nozzles to obtain spherical toner particles; the method disclosed in Japanese Patent Publication No. S36-10231 and Japanese Patent Applications Laid-open No. S59-53856 and No. S59-61842, in which toner particles are directly produced by suspension polymerization; a dispersion polymerization process in which toner particles are directly produced using an aqueous organic solvent in which monomers are soluble and polymers obtained are insoluble, or an emulsion polymerization process as typified by soap-free polymerization in which toner particles are produced by direct polymerization in the presence of a water-soluble polar polymerization initiator; or a hetero-agglomeration process in which primary polar emulsion polymerization particles are previously made and thereafter polar particles having reverse-polarity electric charges are added to effect association.

What is called a seed polymerization process may also preferably be used in the present invention, which is a process in which a monomer is further adsorbed on polymerization toner particles obtained first and thereafter a polymerization initiator is used to effect polymerization.

In the toner particles, the desired additive is further well mixed by external addition optionally by means of a mixing machine such as Henschel mixer to obtain the toner used in the present invention.

Then, in the toner of the present invention, in addition to the fine silica powder described above that is used at least in the present invention, the following external additive may be mixed by external addition.

In the present invention, it is favorable that a fluidity-providing agent such as an inorganic fine powder of silica, alumina, titanium oxide or the like or an organic fine powder of polytetrafluoroethylene, polyvinylidene fluoride, polymethyl methacrylate, polystyrene, silicone or the like is externally added. The mixing of the above fluidity-providing agent in the toner by external addition brings the fine powder into presence between the toner and the carrier or between toner particles one another. Hence, this is suited to provide the toner with favorable fluidity. In addition, this brings improvements in charging rise performance, environmental stability, fluidity, transfer performance and so forth of the developer, and also brings an improvement in service life of the developer.

The fluidity-providing agent described above may preferably have a number average particle diameter of from 3 nm to 200 nm.

Such a fluidity-providing agent may desirably have a BET specific surface area of 30 $m^2/g$ or more, and particularly in the range of from 50 $m^2/g$ to 400 $m^2/g$, as measured by nitrogen adsorption according to the BET method.

At least one kind of such a fluidity-providing agent may preferably be added in addition to the fine silica powder that is mixed in the toner of the present invention by external addition, whereby the toner to be obtained can be improved in chargeability, environmental stability, fluidity and so forth.

In particular, where the toner is a negatively chargeable toner, it is preferable to use titanium oxide for at least one kind, in addition to the fine silica powder that is mixed in the toner of the present invention by external addition. That is, the fine silica powder has higher negative chargeability than fluidity-providing agents such as fine alumina powder and fine titanium oxide powder, and hence has so high adherence to toner base particles that the external additive(s) may less come liberated. Hence, members can be kept from contamination. On the other hand, it tends to cause an increase in charge quantity in an environment of low humidity of the toner. As for the fine titanium oxide powder, it can uniform charging rise performance, charge-up proofness, environmental stability and charge distribution. On the other hand, it may cause a lowering of chargeability of the toner during long-term service.

Accordingly, at least two agents, the fine silica powder that is used at least in the present invention and the fine titanium oxide powder, may be used in combination, as being much preferable because a cooperative effect can be obtained in which properties of the both have been tempered with each other.

In order to maintain chargeability in an environment of high humidity, the fluidity-providing agent may preferably be hydrophobic-treated. An example of such hydrophobic treatment is shown below.

A silane coupling agent is available as one of hydrophobic-treating agents. It may be used in an amount of from 1 part by mass to 40 parts by mass, and preferably from 2 parts by mass to 35 parts by mass, based on 100 parts by mass of the silica. As long as the treating agent is in an amount of from 1 part by mass to 40 parts by mass, the toner can be improved in moisture resistance to make agglomerates not easily occur.

As another hydrophobic-treating agent, silicone oil is also available.

For the purpose of providing various toner properties, other external additives may be added. Such external additives may preferably have a particle diameter of not larger than ⅕ of the weight average diameter of the toner in view of their durability when added to the toner particles. As these additives, used for the purpose of providing various properties, an abrasive, a lubricant and charge controlling particles may be used, for example.

As the abrasive, it may include, e.g., metal oxides such as strontium oxide, cerium oxide, aluminum oxide, magnesium oxide and chromium oxide; nitrides such as silicon nitride; carbides such as silicon carbide; and metal salts such as calcium sulfate, barium sulfate and calcium carbonate.

As the lubricant, it may include, e.g., powders of fluorine resins such as vinylidene fluoride and polytetrafluoroethylene, and fatty acid metal salts such as zinc stearate and calcium stearate.

As the charge controlling particles, they may include, e.g., particles of metal oxides such as tin oxide, titanium oxide, zinc oxide, silicon oxide and aluminum oxide; and carbon black.

Any of these additives may preferably be used in an amount of form 0.1 part by mass to 10 parts by mass, and much preferably form 0.1 part by mass to 5 parts by mass, based on 100 parts by mass of the toner particles.

The carrier used together when the toner of the present invention is used as a two-component developing is described next.

In the case when the toner of the present invention is used in the two-component developer, the toner is used in the form of its blend with a carrier. As the carrier, usable are known carriers such as magnetic-material particles per se, a coated carrier comprising magnetic-material particles coated with a resin, and a magnetic-material-dispersed resin carrier comprising magnetic-material particles dispersed in resin particles. As the magnetic-material particles, usable are, e.g., particles of metals such as iron, lithium, calcium, magnesium, nickel, copper, zinc, cobalt, manganese, chromium and rare earth elements, which may be surface-oxidized or unoxidized, and alloy particles or oxide particles of any of these, and ferrite particles.

The coated carrier comprising carrier particles surface-coated with a resin is particularly preferred in developing methods in which an AC bias is applied to a developing sleeve. As methods for coating, applicable are conventionally known methods such as a method in which a coating fluid prepared by dissolving or suspending a coating material such as a resin in a solvent is made to adhere to the surfaces of carrier core particles, and a method in which the carrier core particles and the coating material are mixed in the form of a powder.

The coating material on the surfaces of carrier core particles may include silicone resins, polyester resins, styrene resins, acrylic resins, polyamide, polyvinyl butyral, and aminoacrylate resins. Any of these may be used alone or in plurality. In the treatment with the coating material, it may preferably be used in an amount of from 0.1% by mass to 30% by mass, and much preferably from 0.5 to 20% by mass, based on the mass of the carrier core particles. Such carrier core particles may preferably have a volume base 50% particle diameter (D50) of from 10 μm to 100 μm, and much preferably from 20 μm to 70 μm.

The volume base 50% particle diameter is measured with a laser diffraction particle size distribution meter (manufactured by Horiba Ltd.).

Where the two-component developer is prepared by blending the toner of the present invention and the carrier, they may preferably be blended in a proportion of from 2% by mass to 15% by mass, and preferably from 4% by mass to 13% by mass, as toner concentration in the developer, where good results are obtainable. If the toner concentration is less than 2% by mass, image density tends to lower. If it is more than 15% by mass, fog or in-machine toner scatter tends to occur.

The toner of the present invention is applicable to image forming methods making use of known one-component developing system and two-component developing system, as, e.g., a toner for a high-speed system, a toner for oilless fixing, a toner for a cleanerless system and a toner for a developing system in which a carrier held in a developer container and having deteriorated as a result of long-term service is collected in turn and a virgin carrier is replenished on (an auto-refresh developing system). In particular, the toner of the present invention has a very good transfer performance and can give stable images over a long period of time, and hence may favorably be used in an image forming method making use of an intermediate transfer member and in an image forming method having a cleanerless system.

Image forming methods to which the toner of the present invention is applicable are described next.

Such image forming methods are described below with reference to the accompanying drawings.

FIG. 1 is a view showing schematically an example of an image forming method to which the toner of the present invention is applicable. The image forming method in this example is of a tandem type in which a plurality of photosensitive members as image bearing members are longitudinally arranged and is an electrophotographic color (multicolor image) printer of an intermediate transfer belt system.

Letter symbols PY, PM, PC and PBk denote first to fourth four image forming sections (image forming units) where toner images of yellow (Y), magenta (M), cyan (C) and black (Bk) colors, respectively, are formed, and are arranged in parallel in this order from the bottom in the main body of the image forming system.

These first to fourth four image forming sections PY, PM, PC and PBk have construction and electrophotographic imaging function which are the same except that the toner images differ in colors as above. More specifically, the first to fourth four image forming sections each consist of a drum type electrophotographic photosensitive member (photosensitive drum) 1 as a first image bearing member, a charging roller 2 as a primary charging means, an exposure unit 3 as an exposure means, a developing assembly 4 as a developing means, a primary transfer roller 5 as a primary transfer means, a blade cleaning unit 6 as a cleaning means and so forth. Developers held in developing assemblies 4 of the first to fourth four image forming sections are a yellow toner, a cyan toner, a magenta toner and a black toner, respectively. The magenta toner used here is a magenta toner of the present invention.

In the image forming method in this example, the first to fourth four image forming sections PY, PM, PC and PBk are each so set up as a process unit (process cartridge) that four processing machines, the photosensitive drum 1, the charging roller 2, the developing assembly 4 and the blade cleaning unit 6, are set detachably replaceable in one lot, to the main body of the image forming system.

Reference numeral 30 denotes an intermediate transfer belt serving as a second image bearing member, and is, on the side of the photosensitive drums 1 of the first to fourth four image forming sections PY, PM, PC and PBk (on the front side of the printer), so provided in the longitudinal direction as to extend over the whole of the four image forming sections and be stretched passing about a plurality of support rollers (not shown). In the first to fourth image forming sections, the primary transfer rollers 5 are respectively kept in pressure contact with the photosensitive drums 1 through this intermediate transfer belt 30. The areas of contact between the respective photosensitive drums 1 and the intermediate transfer belt 30 are primary transfer zones.

In the first to fourth respective image forming sections PY, PM, PC and PBk, respective photosensitive drums 1 kept forward rotatingly driven are, in the course of their rotation, each uniformly primarily electrostatically charged to stated polarity and potential by means of the charging roller 2, to which a charging bias is applied from a power source circuit (not shown). The surfaces thus charged electrostatically are exposed to optical imagewise exposure light LY, LM, LC and LBk in accordance with image patterns of yellow, magenta, cyan and black colors, respectively, which are color-separated component images of a full-color image, by means of a laser exposure unit such as an LED array unit, so that electrostatic latent images of image information are respectively formed on the photosensitive drums 1. Then, the electrostatic latent images thus formed are respectively developed as toner images by the corresponding developing assemblies 4, whereupon toner images of yellow, magenta, cyan and black colors which are color-separated component images of a full-color image are respectively formed by electrophotographic processing on the surfaces of the photosensitive drums 1 of the first to fourth four image forming sections PY, PM, PC and PBk at preset sequence control timing.

Then, in the first to fourth respective image forming sections PY, PM, PC and PBk, the toner images of yellow, magenta cyan and black colors which have been formed respectively on the surfaces of the photosensitive drums 1 are sequentially transferred in a superimposed state to the surface of the intermediate transfer belt 30, which is rotatingly driven at the same peripheral speed as the photosensitive drums 1 in the clockwise direction shown by an arrow that is the direction regular to the forward rotational direction of each photosensitive drum 1; the toner images being transferred by the aid of a primary transfer bias applied from a power source circuit (not shown) at the primary transfer zones of the first to fourth respective image forming sections PY, PM, PC and PBk. Thus, an unfixed full-color toner image (mirror image) is synthetically formed on the surface of the intermediate transfer belt 30.

In the first to fourth respective image forming sections PY, PM, PC and PBk, transfer residual toner having remained on each photosensitive drum 1 after the primary transfer of the tone images to the intermediate transfer belt 30 is removed by cleaning blades of the blade cleaning units 6 and collected and kept in collecting spaces in the blade cleaning units 6.

Reference numeral 32 denotes a secondary transfer roller; and 32*a*, an opposing roller. The opposing roller 32*a* is provided on the inside of the intermediate transfer belt at the bottom of the intermediate transfer belt 30, and the secondary transfer roller 32 is provided in contact with the outer surface of the intermediate transfer belt 30, holding the intermediate transfer belt 30 between itself and the opposing roller 32*a*. The area of contact between the secondary transfer roller 32 and the intermediate transfer belt 30 is a secondary transfer zone.

Reference numeral 40 denotes a paper feed cassette provided at a lower part of the image forming system main body, and transfer materials P as final recording mediums are held therein in a pile. A CPU makes transport means pick-up rollers 31 drive at preset sequence control timing so as to feed sheet by sheet separately the transfer materials P held in the paper feed cassette 40, and transport each sheet to the secondary transfer zone at preset sequence control timing. The unfixed full-color toner image formed synthetically on the intermediate transfer belt 30 is, at this secondary transfer zone, one time transferred on to the transfer material P by the aid of a secondary transfer bias applied from a power source circuit (not shown).

The transfer material P having passed through the secondary transfer zone is separated from the surface of the intermediate transfer belt 30, and is sent to a fixing assembly 7 by a paper transport belt 35.

Transfer residual toner having remained on the intermediate transfer belt 30 is removed by a cleaning blade of an intermediate transfer belt cleaning unit 33, and collected and kept in a waste toner box 34.

The unfixed full-color toner image on the transfer material P sent to the fixing assembly 7 is fused and fixed by the fixing assembly 7 to the transfer material P under application of heat and pressure, and then delivered as a color image-formed matter though a short path 41 onto a paper take-off tray 36 provided on the top surface of the image forming system main body.

Next, as an example of an image forming method making use of the two-component developing system to which the toner of the present invention is applicable, a cleanerless image forming method is described below.

Figure 2:
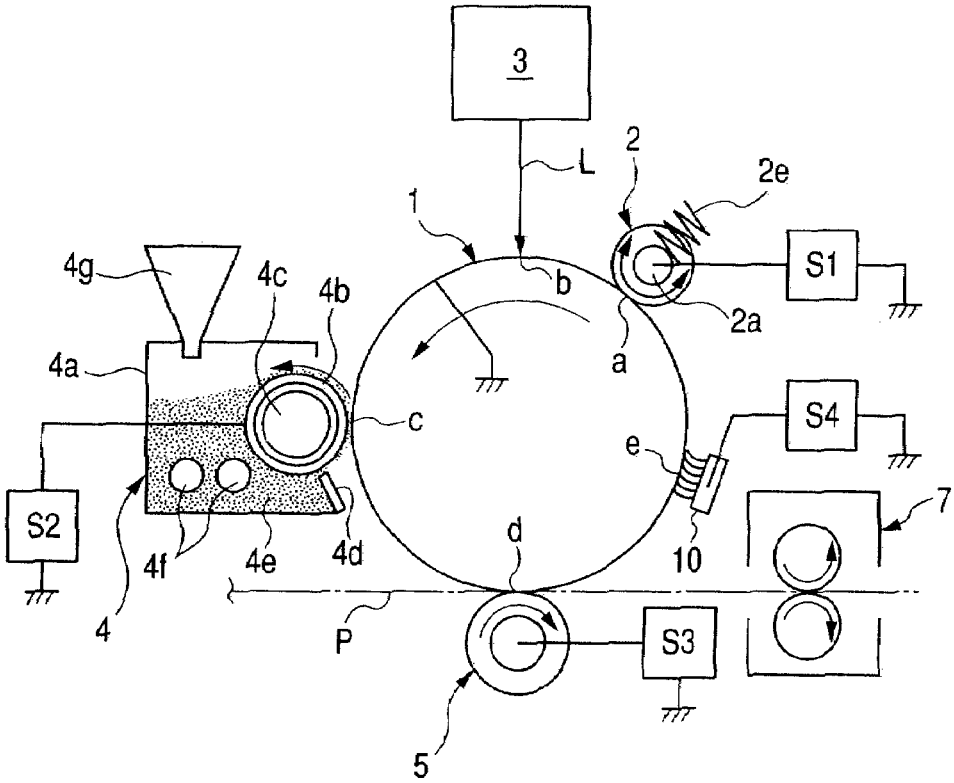
FIG. 2 is a schematic illustration showing an example of an image forming apparatus applicable to the present invention.

FIG. 2 is a schematic structural diagrammatic view showing an example of the image forming method according to the present invention. The image forming method of this example serves a laser beam printer utilizing an electrophotographic process of a transfer system, which is of a contact charging system, a reversal development system and a cleanerless system and has a maximum paper feed size of A3 size.

As shown in FIG. 2, the printer has a photosensitive drum 1 as an image bearing member, a charging roller 2 as a primary charging means, an exposure unit 3 as an exposure means, a developing assembly 4 as a developing means, a primary transfer roller 5 as a transfer means and a fixing assembly 7 as a fixing means.

Reference numeral 2 denotes a contact charging unit (contact charging assembly) as a charging means which uniformly electrostatically charges the peripheral surface of the photosensitive drum 1, and is a charging roller (roller charging assembly) in this example.

This charging roller 2 is rotatably supported on a mandrel at its both ends by bearings (each not shown). It is also brought into pressure contact with the surface of the photosensitive drum 1 under a stated pressing force while being pressed by a pressing spring (not shown) in the photosensitive drum direction, and is follow-up rotated as the photosensitive drum 1 is rotated. The area of contact between the photosensitive drum 1 and the charging roller 2 is a charging zone (charging nip zone).

To the mandrel of the charging roller 2, a charging bias voltage under sated conditions is applied from a power source (not shown), whereby the peripheral surface of the photosensitive drum is electrostatically charged to stated polarity and potential. In this example, as the charging bias voltage applied to the charging roller 2, a vibrating voltage is applied which is formed by superimposing a DC voltage (Vdc) and an AC voltage (Vac).

Stated specifically, a vibrating voltage is applied which is formed by superimposing a DC voltage: −500 V and an AC voltage of frequency: 1,000 Hz, peak-to-peak voltage Vpp: 1,400 V a waveform of which is a sinusoidal waveform, and the peripheral surface of the photosensitive drum is uniformly electrostatically charged to −500 V (dark potential Vd) by contact charging.

Reference numeral 3 denotes an exposure unit 3 as an information-writing means which forms electrostatic latent images on the surface of the photosensitive drum 1. There may be available a method making use of an LED array, a method making use of a semiconductor laser, a method making use of a liquid-crystal shutter array, and so forth.

In this example, it is a laser beam scanner making use of a semiconductor laser. Laser light modulated in accordance with image signals sent to the printer side from a host unit such as an image reading unit is outputted to subject the surface to be uniformly electrostatically charged, of the photosensitive drum 1 to laser scanning exposure L (imagewise exposure) at an exposure position b; the photosensitive drum being rotated. Upon this laser scanning exposure L, the potential lowers at areas having been irradiated with laser light on the surface of the photosensitive drum 1, so that electrostatic latent images corresponding to image information which are formed by such scanning exposure are successively formed on the surface of the photosensitive drum 1 being rotated.

Reference numeral 4 denotes a developing assembly (developing unit) as a developing means which feeds a developer (toner) to the electrostatic latent images formed on the surface of the photosensitive drum 1, to render the electrostatic latent images visible. In this example, it is a reversal developing assembly of the two-component developing system.

Reference numeral 4*a* denotes a developer container; and 4*b*, a non-magnetic developing sleeve. This developing sleeve 4*b* is rotatably provided in the developer container in the state its peripheral surface is partially laid bare to the outside. Reference numeral 4*c* denotes a magnet roller which is so provided as to be inserted to the developing sleeve 4*b* in the state it is non-rotatably fastened; 4*d*, a developer coating blade; 4*e*, a two-component developer held in the developer container; 4*f*, a developer agitating member provided on the bottom side inside the developer container; and 4*g*, a toner hopper, which is kept holding therein a replenishing toner.

Thus, the toner component in the developer coated in the form of a thin layer on the surface of the developing sleeve 4*b*, which is being rotated, and transported to a developing zone c adheres selectively to the surface of the photosensitive drum 1 in accordance with electrostatic latent images by the aid of an electric field formed by a development bias under stated conditions, applied from a power source S2, whereby the electrostatic latent images are developed as toner images. In the case of this example, the toner adheres to exposed light areas of the photosensitive drum 1 surface and the electrostatic latent images are reversely developed.

The developer thin layer remaining on the developing sleeve 4*b* having passed through the developing zone c is returned to a developer collecting space inside the developer container 4*a* as the developing sleeve is subsequently rotated.

In order that the toner concentration of the two-component developer 4*e* held in the developer container 4*a* can be maintained in a stated substantially constant range, the toner concentration of the two-component developer 4*e* held in the developer container 4*a* is detected with, e.g., an optical toner concentration sensor (not shown), and the toner hopper 4*g* is drive-controlled in accordance with the detected information, and then the toner in the toner hopper is replenished to the two-component developer 4*e* held in the developer container 4*a*. The toner replenished to the two-component developer 4*e* is agitated by the developer agitating member 4*f*.

Reference numeral 5 denotes a transfer assembly, and is a transfer roller in this example. This transfer roller 5 is kept in pressure contact with the photosensitive drum 1 at a stated pressing force, and its pressure contact area is a transfer zone d. To this transfer zone d, a transfer material (a transfer medium or a recording material) P is fed though a paper feed mechanism (not shown) at preset sequence control timing.

The transfer material P fed to the transfer zone d is transported while being held between the photosensitive drum 1 and the transfer roller 5, which are being rotated. In that course, a transfer bias with positive polarity, +2 kV in this example, which is a polarity reverse to the regular charge polarity of the toner, is applied to the transfer roller 5 from a power source S3. Thus, toner images on the side of the photosensitive drum 1 surface are successively electrostatically transferred on to the surface of the transfer material P that is transported on through the transfer zone d while being held between.

The transfer material P having passed though the transfer zone d and received the toner images is successively separated from the photosensitive drum 1 surface, transported to the fixing assembly 6 (e.g., heat roller fixing assembly), where the toner images are fixed, and then put out as an image-formed matter (a print or a copy).

The cleanerless system and the controlling of toner charge quantity are described next.

The printer of this example is cleanerless, and is not provided with any cleaning unit for exclusive use to remove transfer residual toner that may remain a little on the photosensitive drum 1 surface after the toner images have been transferred to the transfer material P. The transfer residual toner on the photosensitive drum 1 surface after transfer is carried to the developing zone c through a charging zone a and an exposure zone b as the photosensitive drum 1 is subsequently rotated, where it is collected by cleaning-at-development by the developing assembly 4 (the cleanerless system).

In the present example, the developing sleeve 4*b* of the developing assembly 4 is, as mentioned previously, rotated in the direction opposite to the direction of movement of the photosensitive drum 1 surface at the developing zone c, and this is advantageous to the collection of the transfer residual toner remaining on the photosensitive drum 1.

The transfer residual toner on the photosensitive drum 1 surface passes through the exposure zone b, and hence the step of exposure is done from above the transfer residual toner. However, the transfer residual toner is in so small a quantity that any great influence may come.

However, as stated previously, one having regular polarity as charge polarity, one having reverse polarity (reversal toner) and one having a small charge quantity are mixedly present in the transfer residual toner. Thus, it follows that the reversal toner or toner having a small charge quantity may adhere to the charging roller 2 when it passes through the charging zone a, to make the charging roller undergo contamination with toner beyond tolerance to cause faulty charging.

In addition, in order that the transfer residual toner on the photosensitive drum 1 surface can effectively be collected at development by the developing assembly 4, the charge polarity of the transfer residual toner on photosensitive drum that is carried to the developing zone c must be regular polarity and its charge quantity must be the charge quantity of toner in which the electrostatic latent images on the photosensitive drum 1 can be developed by the developing assembly. About the reversal toner and the toner the charge quantity of which is improper, they can not be removed at and collected in the developing assembly from the photosensitive drum 1 surface to inevitably come to cause faulty images.

Accordingly, in the present example, a toner charge quantity control means 10 for making the charge polarity of the transfer residual toner uniform with the negative polarity that is the regular polarity is provided at a position on the side downstream to the transfer zone d in the rotational direction of the photosensitive drum and on the side upstream to the charging zone a in the rotational direction of the photosensitive drum.

Making the charge polarity of the transfer residual toner uniform with the negative polarity that is the regular polarity enlarges mirror force on the photosensitive drum 1 when the photosensitive drum 1 surface is electrostatically charged from above the transfer residual toner at the charging zone a positioned further downstream, thus the transfer residual toner is prevented from adhering to the charging roller 2.

The collection of the transfer residual toner in the step of development is described next.

The developing assembly 4 is as described above, and is of the cleanerless system in which the transfer residual toner is removed when development is performed.

The toner charge quantity in which the transfer residual toner on the photosensitive drum 1 is to be collected in the developing assembly 4 must be charge quantity having an absolute value that is smaller than the absolute value of charge quantity at the time of charge treatment made by the toner charge quantity control means 10. This is what is called destaticization (charge elimination), and is because any transfer residual toner having a high charge quantity exceeds in affinity for the photosensitive drum to come not to be collected in the developing assembly 4 to cause image defects.

However, in order that the transfer residual toner having been charged greatly to negative polarity by the toner charge quantity control means 10 in order to prevent the toner from adhering to the charging roller 2 is collected in the developing assembly 4, it is necessary to effect the destaticization. This destaticization is effected at the charging zone a. More specifically, since an AC voltage of 1,000 Hz and 1,400 V is applied to the charging roller 2 as stated previously, the transfer residual toner is treated by AC destaticization. The charge quantity after pass through the charging zone a may also be controlled by AC destaticization by controlling the AC voltage applied to the charging roller 2. In the development step, the transfer residual toner on the photosensitive drum 1 where the toner should not participate in development is collected in the developing assembly 4 for the reason stated above.

Thus, the charge treatment is so carried out that the triboelectricity of the transfer residual toner on the photosensitive drum 1, carried from the transfer zone d to the charging zone a is made uniform with the regular polarity negative polarity by the toner charge quantity control means 10, which is connected to a power source S4. This enables the photosensitive drum 1 to be charged by the charging roller 2 to a stated potential while preventing the transfer residual toner from adhering to the charging roller 2. At the same time, the charge quantity of the transfer residual toner having been charge-treated to have the regular polarity negative polarity by the above toner charge quantity control means 10 is controlled to the proper charge quantity in which the electrostatic latent images on the photosensitive drum can be developed by the developing assembly 4. This enables efficient collection of the transfer residual toner at the developing assembly. Thus, an image forming method can be provided which is free of faulty charging and faulty images and moreover making the most of the advantage the cleanerless system has.

EXAMPLES

The present invention is described below in greater detail by giving production examples and working examples, which by no means limit the present invention.

Production Example of Fine Silica Powder A

In an outer flame formed of oxygen-hydrogen flame, octamethylcyclotetrasiloxane was burned and oxidized in the oxygen-hydrogen flame (adiabatic flame temperature: 2,010° C.). The base-material fine silica powder obtained was put into a mixer, and was started being agitated under conditions of a mixer internal temperature of 250° C., a peripheral speed of 94 m/s and a degree of mixing for 1 minute of 98%, where nitrogen was made to flow through. This state was retained for 30 minutes, and the base-material fine silica powder was allowed to dry. As a result of this operation, the base-material fine silica powder had a water content of 0.1% by mass or less. The base-material fine silica powder thus obtained was 131 $m^2/g$ in BET specific surface area and 16 nm in number average primary particle diameter.

Subsequently, the agitation with the mixer was continued under the like conditions, where 21.5 parts by mass of dimethylsilicone oil (viscosity: 50 $mm^2/s$) was sprayed on 100 parts by mass of the base-material fine silica powder by using a binary nozzle to make it adhere to the base-material fine silica powder.

Figure 3:
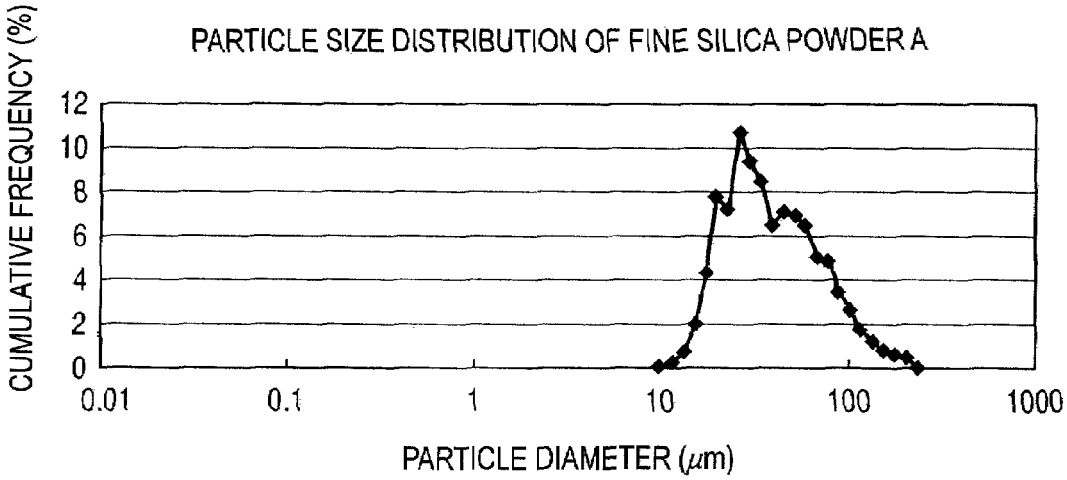
FIG. 3 is a graph showing an example of particle size distribution of the fine silica powder.

Further, the agitation with the mixer was continued under the like conditions, and this was retained for 60 minutes, followed by cooling. Thereafter, the product thus treated was disintegrated by means of Pulverizer (manufactured by Hosokawa Micron Corporation) to obtain fine silica powder A having been surface-treated with silicone oil. Physical properties of the fine silica powder A obtained are shown in Table 2. Particle size distribution of the fine silica powder A is also shown in FIG. 3.

Production Examples of Fine Silica Powders B to I

The procedure of Production Example of Fine Silica Powder A was repeated except that the number of revolutions of Pulverizer and the feed rate were changed to control the value of A/B and so forth (disintegration strength increases with increasing the number of revolutions and/or decreasing the feed rate. With an increase in the disintegration strength, the value of A/B increases). Physical properties of the fine silica powders B to I obtained are shown in Table 2.

Production Examples of Fine Silica Powders J to O

The procedure of Production Example of Fine Silica Powder A was repeated except that the dimethylsilicone oil was added in amounts of 20.0 parts by mass, 17.5 parts by mass, 15.0 parts by mass, 29.8 parts by mass, 33.9 parts by mass and 38.0 parts by mass, respectively. Physical properties of the fine silica powders B to I obtained are shown in Table 2.

Production Example of Fine Silica Powder P

In an outer flame formed of oxygen-hydrogen flame, octamethylcyclotetrasiloxane was burned and oxidized in the oxygen-hydrogen flame (adiabatic flame temperature: 2,130° C.). Care was taken for this base-material fine silica powder not to be subjected to any operation at all such as mixing that might accelerate mutual contact between particles of the fine powder.

The base-material fine silica powder obtained was put into a mixer, and was started being agitated under conditions of a mixer internal temperature of 250° C., a peripheral speed of 94 m/s and a degree of mixing for 1 minute of 98%, where nitrogen was made to flow through. This state was retained for 30 minutes, and the base-material fine silica powder was allowed to dry. As a result of this operation, the base-material fine silica powder had a water content of 0.1% by mass or less. The base-material fine silica powder thus obtained was 92 $m^2/g$ in BET specific surface area and 20 nm in number average primary particle diameter.

Next, 100 parts by mass of this base-material fine silica powder was added to a solution prepared by dissolving 10 parts by mass of 90% methanol water and 3.46 parts by mass of hexamethyldisilazane (HMDS) in 10,000 parts by mass of hexane, to carry out reaction, and then the solvent was removed. Thereafter, 100 parts by mass of the fine silica powder having been treated with HMDS was put into a mixer, and was started being agitated under conditions of a mixer internal temperature of 250° C., a peripheral speed of 94 m/s and a degree of mixing for 1 minute of 98%, where nitrogen was made to flow through. On this powder, 14.0 parts by mass of dimethylsilicone oil (viscosity: 50 $mm^2/s$) was sprayed by using a binary nozzle to make it adhere to the base-material fine silica powder.

Further, the agitation with the mixer was continued under the like conditions, and this was retained for 60 minutes, followed by cooling. Thereafter, the product thus treated was disintegrated by means of Pulverizer (manufactured by Hosokawa Micron Corporation) to obtain fine silica powder P thus surface-treated. Physical properties of the fine silica powder P obtained are shown in Table 2.

Production Examples of Fine Silica Powders Q to S

The procedure of Production Example of Fine Silica Powder N was repeated except that the number of revolutions of Pulverizer and the feed rate were changed to control the value of "A/B" and the proportion of "from 0.10 μm or more to 200.00 μm or less" so as to be those shown in Table 2 (disintegration strength increases with increasing the number of revolutions and/or decreasing the feed rate. With an increase in the disintegration strength, the value of A/B and the proportion of from 0.10 μm or more to 200.00 μm or less increase). Physical properties of the fine silica powders Q to S obtained are shown in Table 2.

Production Example of Fine Silica Powder T

In an outer flame formed of oxygen-hydrogen flame, octamethylcyclotetrasiloxane was burned and oxidized in the oxygen-hydrogen flame (adiabatic flame temperature: 2,132° C.). Care was taken for this base-material fine silica powder not to be subjected to any operation at all such as mixing that might accelerate mutual contact between particles of the fine powder.

The base-material fine silica powder obtained was put into a mixer, and was started being agitated under conditions of a mixer internal temperature of 250° C., a peripheral speed of 94 m/s and a degree of mixing for 1 minute of 98%, where nitrogen was made to flow through. This state was retained for 30 minutes, and the base-material fine silica powder was allowed to dry. As a result of this operation, the base-material fine silica powder had a water content of 0.1% by mass or less. The base-material fine silica powder thus obtained was 87 $m^2/g$ in BET specific surface area and 21 nm in number average primary particle diameter.

Next, 100 parts by mass of this base-material fine silica powder was added to a solution prepared by dissolving 10 parts by mass of 90% methanol water and 3.27 parts by mass of hexamethyldisilazane (HMDS) in 10,000 parts by mass of hexane, to carry out reaction, and then the solvent was removed. Thereafter, 100 parts by mass of the fine silica powder having been treated with HMDS was put into a mixer, and was started being agitated under conditions of a mixer internal temperature of 250° C., a peripheral speed of 94 m/s and a degree of mixing for 1 minute of 98%, where nitrogen was made to flow through. On this powder, 13.3 parts by mass of dimethylsilicone oil (viscosity: 50 $mm^2/s$) was sprayed by using a binary nozzle to make it adhere to the base-material fine silica powder.

Further, the agitation with the mixer was continued under the like conditions, and this was retained for 60 minutes, followed by cooling. Thereafter, the product thus treated was disintegrated by means of Pulverizer (manufactured by Hosokawa Micron Corporation) to obtain fine silica powder T thus surface-treated. Physical properties of the fine silica powder T obtained are shown in Table 2.

Production Examples of Fine Silica Powder U

The procedure of Production Example of Fine Silica Powder T was repeated except that the adiabatic flame temperature was 2,135° C. and the hexamethyldisilazane (HMDS) and the dimethylsilicone oil were used in amounts of 3.08 parts by mass and 12.5 parts by mass, respectively. Physical properties of the fine silica powder U obtained are shown in Table 2.

Production Example of Fine Silica Powder V

In an outer flame formed of oxygen-hydrogen flame, octamethylcyclotetrasiloxane was burned and oxidized in the oxygen-hydrogen flame (adiabatic flame temperature: 1,720° C.). Care was taken for this base-material fine silica powder not to be subjected to any operation at all such as mixing that might accelerate mutual contact between particles of the fine powder.

The base-material fine silica powder obtained was put into a mixer, and was started being agitated under conditions of a mixer internal temperature of 250° C., a peripheral speed of 94 m/s and a degree of mixing for 1 minute of 98%, where nitrogen was made to flow through. This state was retained for 30 minutes, and the base-material fine silica powder was allowed to dry. As a result of this operation, the base-material fine silica powder had a water content of 0.1% by mass or less. The base-material fine silica powder thus obtained was 398 $m^2/g$ in BET specific surface area and 6 nm in number average primary particle diameter.

Subsequently, the agitation with the mixer was continued under the like conditions, where 59.0 parts by mass of dimethylsilicone oil (viscosity: 50 $mm^2/s$) was sprayed on 100 parts by mass of the base-material fine silica powder by using a binary nozzle to make it adhere to the base-material fine silica powder.

Further, the agitation with the mixer was continued under the like conditions, and this was retained for 60 minutes, followed by cooling. Thereafter, the product thus treated was disintegrated by means of Pulverizer (manufactured by Hosokawa Micron Corporation) to obtain fine silica powder V having been surface-treated with silicone oil. Physical properties of the fine silica powder V obtained are shown in Table 2.

Production Examples of Fine Silica Powder W

The procedure of Production Example of Fine Silica Powder T was repeated except that the adiabatic flame temperature was 1,715° C. and the dimethylsilicone oil was used in an amount of 66 parts by mass. Physical properties of the fine silica powder W obtained are shown in Table 2.

TABLE 2

| Fine silica powder | A (%) | A + B (%) | A/B | BET sp. surface area (m2/g) | C content/ BET | 0.10 μm or more to 1.00 μm or less (%) | 77.34 μm or more to 200.00 μm or less (%) | Wettability (%) |
|---|---|---|---|---|---|---|---|---|
| A | 52.4 | 100.0 | 1.10 | 80 | 0.040 | 0 | 17.5 | 72 |
| B | 34.2 | 100.0 | 0.52 | 81 | 0.040 | 0 | 19.8 | 73 |
| C | 33.3 | 100.0 | 0.50 | 81 | 0.040 | 0 | 22.0 | 74 |
| D | 31.0 | 100.0 | 0.45 | 82 | 0.040 | 0 | 25.1 | 72 |
| E | 28.6 | 100.0 | 0.40 | 82 | 0.040 | 0 | 29.0 | 72 |
| F | 66.7 | 100.0 | 2.00 | 76 | 0.040 | 0 | 9.1 | 73 |
| G | 77.8 | 100.0 | 3.50 | 76 | 0.040 | 0 | 6.3 | 73 |
| H | 85.5 | 99.7 | 6.00 | 75 | 0.040 | 0 | 2.5 | 72 |
| I | 87.1 | 99.5 | 7.00 | 73 | 0.040 | 1 | 1.0 | 72 |
| J | 52.8 | 100.0 | 1.12 | 75 | 0.035 | 0 | 16.2 | 70 |
| K | 55.2 | 100.0 | 1.23 | 74 | 0.030 | 0 | 16.0 | 70 |
| L | 56.5 | 100.0 | 1.30 | 80 | 0.025 | 0 | 15.2 | 67 |
| M | 48.7 | 100.0 | 0.95 | 65 | 0.050 | 0 | 20.1 | 74 |
| N | 44.4 | 100.0 | 0.80 | 67 | 0.055 | 0 | 22.3 | 75 |
| O | 42.9 | 100.0 | 0.75 | 72 | 0.060 | 0 | 24.5 | 77 |
| P | 81.6 | 97.0 | 5.31 | 40 | 0.040 | 3 | 4.0 | 71 |
| Q | 80.0 | 95.0 | 5.33 | 41 | 0.040 | 5 | 3.2 | 72 |
| R | 78.7 | 93.0 | 5.52 | 40 | 0.040 | 7 | 2.6 | 71 |
| S | 78.6 | 92.0 | 5.89 | 42 | 0.040 | 8 | 1.3 | 71 |
| T | 78.5 | 93.0 | 5.43 | 35 | 0.040 | 1 | 6.0 | 71 |
| U | 78.7 | 93.0 | 5.51 | 30 | 0.040 | 1 | 6.0 | 70 |
| V | 66.1 | 100.0 | 1.95 | 350 | 0.035 | 0 | 18.5 | 74 |
| W | 65.2 | 99.0 | 1.93 | 400 | 0.035 | 1 | 20.1 | 75 |

Production Examples of Carrier 1

As components for a ferrite, 26.0 mol % of MnO, 3.0 mol % of MgO, 70.0 mol % of $Fe_2O_3$ and 1.0 mol % of $SrCO_3$ were pulverized for 5 hours and mixed by means of a wet ball mill, followed by drying. The dried product obtained was retained at 900° C. for 3 hours to carry out calcination. This calcined product was so pulverized for 7 hours by means of the wet ball mill as to be 2 μm or less in particle diameter. To this slurry, 2.0% by mass of a binder (polyvinyl alcohol) was added, and then this slurry was granulated by means of a spray dryer (manufacturer: Ohkawara Kakohki Co., Ltd.), followed by drying to obtain a granulated product of about 40 μm in volume base 50% particle diameter (D50). This granulated product was put into an electric furnace, and retained at 1,150° C. for 3 hours in a mixed gas of nitrogen and oxygen the concentration of the latter in the former was controlled to 2.0 vol. %, to carry out firing. The fired product obtained was disintegrated, and further sieved with a sieve (mesh opening: 75 μm) to obtain magnetic carrier core particles 1 of 34 μm in volume base 50% particle diameter (D50). The core article surfaces of this product were observed by SEM to find that the core particles had grooves on their surfaces.

Next, the following components were mixed with 300 parts by mass of xylene to make up a carrier resin-coating fluid.

| | |
|---|---|
| Straight silicone resin (KR255, available from Shin-Etsu Chemical Co., Ltd; in terms of solid content) | 100 parts by mass |
| Silane type coupling agent (γ-aminopropylethoxysilane) | 10 parts by mass |
| Carbon black (CB) (number average particle diameter: 30 nm; DBP oil absorption: 50 ml/100 g) | 10 parts by mass |

With agitation of this carrier resin-coating fluid by using its fluidized bed heated to 70° C., coating on and solvent removal from the carrier core particles 1 were so operated that the straight silicone resin came to be in a mass of 12.0% by mass based on the mass of the carrier core particles.

Further, using an oven, the coated product obtained was treated at 230° C. for 2.5 hours, followed by disintegration and then classification using a sieve (mesh opening: 75 μm) to obtain Carrier 1.

Example 1

An aqueous dispersion medium and a polymerizable monomer composition were each prepared in the following way.

Preparation of Aqueous Dispersion Medium:

In 292 parts by mass of ion-exchanged water, 47 parts by mass of an aqueous 0.1 mol/liter $Na_3PO_4$ solution was introduced, followed by heating to 60° C. and thereafter stirring at 13,000 rpm by using a TK-type homomixer (manufactured by Tokushu Kika Kogyo Co., Ltd.). To the resultant mixture, 68.5 parts by mass of an aqueous 1.0 mol/liter $CaCl_2$ solution was slowly added to obtain an aqueous medium of pH 6 containing a calcium phosphate compound.

Preparation of Polymerizable Monomer Composition:

| | |
|---|---|
| Styrene | 83 parts by mass |
| n-Butyl acrylate | 17 parts by mass |
| Colorant (C.I. Pigment Blue 15:3) | 5 parts by mass |
| Charge control agent (3,5-di-t-butylsalicylic acid metal compound) | 1 part by mass |
| Saturated polyester resin obtained by condensation polymerization of propylene oxide and ethylene oxide addition products of bisphenol A with terephthalic acid (Mw: 10,000; AV (acid value): 6 mgKOH/g) | 4 parts by mass |
| Divinylbenzene | 0.05 part by mass |

The above components were heated to 60° C. and well dissolved and dispersed to obtain a dispersion composition.

Then, in this dispersion composition, a mixture prepared previously by mixing 3.5 parts by mass of an organic peroxide type initiator t-butyl peroxypivarate and 1.5 parts by mass of toluene was dissolved to obtain a polymerizable monomer composition. This composition was introduced into the above aqueous dispersion medium, and these were stirred at a high speed by means of a high-speed rotary-shearing stirrer CLEAMIX (manufactured by $M_{TECHNIQUE}$ Co., LTD.) to carry out granulation for 10 minutes. This stirrer was changed for a paddle stirring blade, and polymerization was continued at an internal temperature of 65° C. After the polymerization reaction was carried out for 5 hours, 5 parts by mass of anhydrous sodium carbonate was added to the system, and thereafter the polymerization temperature was raised to 80° C., where the stirring was further continued for 5 hours to complete the polymerization reaction (after reaction was completed, the pH of the suspension was 10.6). The reaction product obtained was cooled, and thereafter solid-liquid separated and then washed with water, followed by re-slurrying and further addition of dilute hydrochloric acid to dissolve the dispersing agent. This was again solid-liquid separated, washed with water and then filtered, followed by drying to obtain polymerization toner particles (6.0 μm).

100 parts by mass of the cyan toner particles thus obtained, 1.8 parts by mass of the fine silica powder A and 0.2 part by mass of rutile titanium oxide powder (number average primary particle diameter: 30 nm) having been surface-treated with i-butyltrimethoxysilane and dimethylsilicone oil were dry-process mixed for 5 minutes by means of Henschel mixer (manufactured by Mitsui Mining Co. Ltd.) to obtain Toner 1 of the present invention.

—Image Evaluation—

A printer manufactured by CANON INC., LBP 5300, was so converted as to be constructed and arranged as shown in FIG. 1 (which was so converted as to use as a toner layer thickness control member a SUS stainless steel blade of 10 μm in thickness and that, as a blade bias, a blade bias of −200 V for development bias was applicable to the toner layer thickness control member), and image evaluation was made in each environment. To make the image evaluation, a cartridge filled with, as its toner, 160 g of the above Toner 1 was mounted to the cyan station, and dummy cartridges were mounted to the other stations.

The image evaluation was made in environments of 15° C./10% RH (low-temperature and low-humidity environment; hereinafter often simply "LL environment") and 30° C./80% RH (high-temperature and high-humidity environment; hereinafter often simply "HH environment"). Operation that an image with a print percentage of 1% was reproduced on one sheet was repeated, and whether or not any development line marks appeared was checked every time the number of sheets in the image reproduction came to 500 sheets. Finally, images were reproduced on 15,000 sheets, and evaluation was made in the following way. The results of evaluation are shown in Table 3. As shown by the results, good results were obtained in all the evaluation.

Evaluation on Development Line Marks (LL Environment)

To check whether or not any development line marks appeared, images were reproduced on 50 sheets and thereafter paused to be done for 5 hours, and this was repeated. Every time the number of sheets in the image reproduction came to 500 sheets, solid images and halftone images were reproduced, and the images were visually observed to make judgment. Evaluation was made for running up to 15,000 sheets. The larger the number of sheets on which the development line marks have begun to appear is, the better the performance against the development line marks is.

A: Any development line mark does not appear up to the 15,000th sheet.

B: Development line marks appear on the 14,001st to 15,000th sheet.

C: Development line marks appear on the 13,001st to 14,000th sheet.

D: Development line marks appear on the 12,001st to 13,000th sheet.

E: Development line marks appear prior to the 12,000th sheet or less.

Evaluation on Image Fog (HH Environment)

When the 15,000-sheet running for evaluation was finished, an image having a white-background area was reproduced. From a difference between whiteness of the white-background area of the image reproduced [reflectance Ds(%)] and whiteness of a transfer sheet [average reflectance Dr(%)] which were measured with REFLECTOMETER Model TC-6DS (manufactured by Tokyo Denshoku Co., Ltd.), fog density (%) [=Ds(%)−Dr(%)] was calculated to make evaluation on image fog when the running for evaluation was finished. As a filter, an amber light filter was used.

A: Less than 0.3%.

B: From 0.3% or more to less than 0.8%.

C: From 0.8% or more to less than 1.3%.

D: From 1.3% or more to less than 2.0%.

Image Density Stability (HH Environment, LL Environment)

Image density was measured with a color reflection densitometer (e.g., X-RITE 504A, manufactured by X-Rite, Incorporated). Images were evaluated on every 100,000th sheet in the HH environment and the LL environment each. About the worst image in the evaluation, evaluation and judgment were made in the following way.

A: Any uneven image density is seen on images, and image density is also stable and good.

B: Any uneven image density is seen on images, but image density has somewhat decreased.

C: Uneven image density is a little seen on images, and image density has decreased.

D: Uneven image density on images and decrease in image density are greatly seen.

Image Uniformity/Image Quality (HH Environment)

1) In the image reproduction test, monochromatic solid images and halftone images were printed at the end of running, and their image uniformity/image quality was evaluated by visual observation.

A: Images are uniform and at a level where no uneven image is recognizable.

B: Images are at a level where uneven images are somewhat recognizable.

C: Images are at a level where uneven images are recognizable.

D: Images are at a level where uneven images are greatly seen.

2) In the image reproduction test, original character images with a 2% duty were printed at the end of running, and their image quality was evaluated by visual observation and by observation with a magnifier.

A: Images are at a level where any spots around line images and/or blank areas are recognizable.

B: Images are at a level where some spots around line images and/or blank areas are recognizable.

C: Images are at a level where spots around line images and/or blank areas are recognizable.

D: Images are at a level where spots around line images and/or blank areas are greatly seen.

Of the above 1) and 2), worse results were taken as evaluation results.

Examples 2 to 4

Toners 2 to 4 were obtained in the same manner as in Example 1 except that the fine silica powder was changed for the fine silica powders B to D, respectively. Evaluation was also made in the same way as in Example 1 to obtain the results shown in Table 3.

Comparative Example 1

Toner 5 was obtained in the same manner as in Example 1 except that the fine silica powder was changed for the fine silica powder E. Evaluation was also made in the same way as in Example 1 to obtain the results shown in Table 3. As shown by the results, the development line marks and so forth appeared seriously in the LL environment. This is presumed due to the fact that the value of A/B was so small that, as a result of long-term service, the fine silica powder tended to come liberated from the toner and the fine silica powder melt-stuck to the toner carrying member and control blade.

Examples 5 to 7

Toners 6 to 8 were obtained in the same manner as in Example 1 except that the fine silica powder was changed for the fine silica powders F to H, respectively. Evaluation was also made in the same way as in Example 1 to obtain the results shown in Table 3.

Comparative Example 2

Toner 9 was obtained in the same manner as in Example 1 except that the fine silica powder was changed for the fine silica powder I. Evaluation was also made in the same way as in Example 1 to obtain the results shown in Table 3. As shown by the results, the development line marks and so forth appeared seriously in the LL environment. This is presumed due to the fact that the value of A/B was so large that, as a result of long-term service, the fine silica powder came buried in toner particles, so that the toner deteriorated and hence the toner melt-stuck to the toner carrying member and control blade.

Examples 8 and 9

Toners 10 and 11 were obtained in the same manner as in Example 1 except that the fine silica powder was changed for the fine silica powders J and K, respectively. Evaluation was also made in the same way as in Example 1 to obtain the results shown in Table 3.

Comparative Example 3

Toner 12 was obtained in the same manner as in Example 1 except that the fine silica powder was changed for the fine silica powder L. Evaluation was also made in the same way as in Example 1 to obtain the results shown in Table 3. As shown by the results, the fog occurred seriously and image uniformity/image quality and so forth were poor in the HH environment. This is presumed due to the fact that the value of C content/BET and the wettability were so small that the fine silica powder tended to absorb moisture to have made the toner unable to be kept well chargeable.

Examples 10 and 11

Toners 13 and 14 were obtained in the same manner as in Example 1 except that the fine silica powder was changed for the fine silica powders M and N, respectively. Evaluation was also made in the same way as in Example 1 to obtain the results shown in Table 3.

Comparative Example 4

Toner 15 was obtained in the same manner as in Example 1 except that the fine silica powder was changed for the fine silica powder O. Evaluation was also made in the same way as in Example 1 to obtain the results shown in Table 3. The results are presumed due to the fact that the value of C content/BET was so large that the fine silica powder tended to again agglomerate even though the disintegration treatment was carried out, so that, as a result of long-term service, the fine silica powder tended to come liberated from the toner and the fine silica powder melt-stuck to the toner carrying member and control blade.

Examples 12 to 14

Toners 16 to 18 were obtained in the same manner as in Example 1 except that the fine silica powder was changed for the fine silica powders P to R, respectively. Evaluation was also made in the same way as in Example 1 to obtain the results shown in Table 3.

Comparative Example 5

Toner 19 was obtained in the same manner as in Example 1 except that the fine silica powder was changed for the fine silica powder S. Evaluation was also made in the same way as in Example 1 to obtain the results shown in Table 3. As shown by the results, the development line marks and so forth appeared seriously in the LL environment. This is presumed due to the fact that the proportion of from 0.10 μm or more to less than 1.00 μm was so large that, as a result of long-term service, the fine silica powder came buried in toner particles, so that the toner deteriorated and hence the toner melt-stuck to the toner carrying member and control blade.

Examples 15 to 18

Toners 20 to 23 were obtained in the same manner as in Example 1 except that the fine silica powder was changed for the fine silica powders T to W, respectively. Evaluation was also made in the same way as in Example 1 to obtain the results shown in Table 3.

Example 19

Toner 24 was obtained in the same manner as in Example 1 except that the amount of the aqueous 0.1 mol/liter $Na_3PO_4$ solution and the amount of the aqueous 1.0 mol/liter $CaCl_2$ solution were changed to 51.8 parts by mass and 70.5 parts by mass, respectively. Evaluation was also made in the same way as in Example 1 to obtain the results shown in Table 3.

Comparative Example 6

Toner 25 was obtained in the same manner as in Example 1 except that the amount of the aqueous 0.1 mol/liter $Na_3PO_4$ solution and the amount of the aqueous 1.0 mol/liter $CaCl_2$ solution were changed to 52.6 parts by mass and 70.8 parts by mass, respectively. Evaluation was also made in the same way as in Example 1 to obtain the results shown in Table 3. As shown by the results, the development line marks and so forth appeared seriously. Accordingly, it is presumed that, even though the fine silica powder used in the present invention was added, the toner was so small in particle diameter as to have a poor fluidity, so that, as a result of long-term service, the fine silica powder came buried in toner particles and the toner deteriorated, and hence the toner melt-stuck to the toner carrying member and control blade.

Example 20

Toner 26 was obtained in the same manner as in Example 1 except that the amount of the aqueous 0.1 mol/liter $Na_3PO_4$ solution and the amount of the aqueous 1.0 mol/liter $CaCl_2$ solution were changed to 38.3 parts by mass and 67.9 parts by mass, respectively. Evaluation was also made in the same way as in Example 1 to obtain the results shown in Table 3.

Comparative Example 7

Toner 27 was obtained in the same manner as in Example 1 except that the amount of the aqueous 0.1 mol/liter $Na_3PO_4$ solution and the amount of the aqueous 1.0 mol/liter $CaCl_2$ solution were changed to 36.9 parts by mass and 67.8 parts by mass, respectively. Evaluation was also made in the same way as in Example 1 to obtain the results shown in Table 3. As shown by the results, the image uniformity/image quality and so forth were poor. It is presumed that, even though the fine silica powder used in the present invention was added, the toner was so large in particle diameter as to be difficult for itself to perform development faithfully to electrostatic latent images and also that the toner tended to scatter when transferred electrostatically.

TABLE 3

| | | Toner | LL | | | | HH | | | |
|---|---|---|---|---|---|---|---|---|---|---|
| | | weight av. particle diam. | Development line marks | Fog | Image density stability | Image uniformity, image quality | Development line marks | Fog | Image density stability | Image uniformity, image quality |
| Ex. 1 | Toner 1 | 6.0 μm | A | A | A | A | A | A | A | A |
| Ex. 2 | Toner 2 | 6.0 μm | A | A | A | A | A | A | A | A |
| Ex. 3 | Toner 3 | 6.0 μm | B | B | B | B | A | A | A | A |
| Ex. 4 | Toner 4 | 6.0 μm | C | C | C | C | B | C | B | B |
| Cp. 1 | Toner 5 | 6.0 μm | E | D | D | D | D | D | C | C |
| Ex. 5 | Toner 6 | 6.0 μm | A | A | A | A | A | A | A | A |
| Ex. 6 | Toner 7 | 6.0 μm | A | B | A | A | A | B | A | A |
| Ex. 7 | Toner 8 | 6.0 μm | B | C | B | B | B | C | B | B |
| Cp. 2 | Toner 9 | 6.0 μm | D | D | C | C | C | D | C | C |
| Ex. 8 | Toner 10 | 6.0 μm | B | B | B | B | B | B | B | B |
| Ex. 9 | Toner 11 | 6.0 μm | C | B | C | C | B | C | B | C |
| Cp. 3 | Toner 12 | 6.0 μm | D | C | C | D | C | D | D | D |
| Ex. 10 | Toner 13 | 6.0 μm | A | B | B | B | A | B | B | B |
| Ex. 11 | Toner 14 | 6.0 μm | B | C | B | B | B | C | B | B |
| Cp. 4 | Toner 15 | 6.0 μm | C | D | C | C | B | D | C | C |
| Ex. 12 | Toner 16 | 6.0 μm | A | A | A | A | A | A | A | A |
| Ex. 13 | Toner 17 | 6.0 μm | B | B | B | B | A | B | B | B |
| Ex. 14 | Toner 18 | 6.0 μm | C | B | C | C | B | C | B | B |
| Cp. 5 | Toner 19 | 6.0 μm | E | C | D | D | C | D | C | C |
| Ex. 15 | Toner 20 | 6.0 μm | B | B | B | B | B | B | B | B |
| Ex. 16 | Toner 21 | 6.0 μm | C | C | C | C | C | C | C | C |
| Ex. 17 | Toner 22 | 6.0 μm | B | B | B | B | B | B | B | B |
| Ex. 18 | Toner 23 | 6.0 μm | C | C | C | C | B | C | B | C |
| Ex. 19 | Toner 24 | 4.0 μm | C | B | B | B | B | B | B | B |
| Cp. 6 | Toner 25 | 3.5 μm | E | C | C | C | D | D | C | C |

TABLE 3-continued

| | Toner | | LL | | | | HH | | | |
|---|---|---|---|---|---|---|---|---|---|---|
| | | weight av. particle diam. | Development line marks | Fog | Image density stability | Image uniformity, image quality | Development line marks | Fog | Image density stability | Image uniformity, image quality |
| Ex. 20 | Toner 26 | 9.0 μm | A | B | B | B | A | B | B | B |
| Ex. 21 | Toner 27 | 10.0 μm | B | B | C | D | B | B | C | D |

Ex.: Example
Cp.: Comparative Example

Example 21

In 100 parts by mass of the same cyan toner particles as those used in Example 1, 1.0 part by mass of the fine silica powder A and 0.7 part by mass of titanium oxide powder (MT150, available from Tayca Corporation) were mixed by means of Henschel mixer (manufactured by Mitsui Miike Engineering Corporation) to obtain Toner 28 of the present invention.

Carrier 1 and this cyan toner were used, and these were so blended that the toner was in a proportion of 8% by mass based on the total mass of these to produce a two-component developer.

Using the two-component developer thus obtained, and using a conversion machine of a commercially available copying machine iRC5185N (manufactured by CANON INC)., an A4-size cyan monochromatic original image with an image duty of 3% was reproduced on 500,000 sheets in a high-temperature and high-humidity environment (32.5° C./90% RH) to make evaluation on changes in image density, image uniformity/image quality, solidness uniformity, fog, and carrier sticking to electrostatic latent image bearing member. The results are shown in Table 4. Measurement conditions and evaluation criteria for these are shown below.

For evaluation on these, a cartridge filled with, as a replenishing toner, 470 g of the above toner was mounted to the cyan station, and dummy cartridges were mounted to the other stations, to make image evaluation.

As sheets of paper, those of Color Laser Copier SK Paper, available from CANON INC., were used which were moisture-conditioned for 24 hours in each environment.

Changes in Image Density:

Image density was measured with a color reflection densitometer (e.g., X-RITE 404, manufactured by X-Rite, Incorporated). Evaluation was made by a difference between initial density and density after image reproduction on 200,000 sheets. In image reproduction in a high-temperature and high-humidity environment (32.5° C./90% RH) and a normal-temperature and low-humidity environment (23° C./15% RH), what showed worse changes in image density was taken up to make evaluation according to the following criteria.

A: 0.1% or less.

B: More than 0.1% to 0.2% or less.

C: More than 0.2%.

Evaluation on Image Fog (HH Environment):

With regard to the fog, after image reproduction on 200,000 sheets was finished, the reflection density of white paper and the reflection density of non-image areas of paper on which images were reproduced using the copying machine were measured with a reflection densitometer (DENSITOMETER TC6MC, manufactured by Tokyo Denshoku Technical Center). The difference in reflection density between the both was examined on the basis of the reflection density of white paper, and what showed the worst fog among areas examined was expressed according to the following evaluation criteria.

A: Less than 0.5%.

B: From 0.5% to less than 0.8%.

C: From 0.8% to less than 1.1%.

D: From 1.1% to less than 2.0%.

E: 2.0% or more.

Image Uniformity/Image Quality (LL Environment, HH Environment)

1) In the image reproduction test, monochromatic solid images and halftone images were reproduced at the end of running, and their image uniformity/image quality was evaluated by visual observation. In image reproduction in the HH environment and LL environment, what showed worse changes in image density was taken up to make evaluation according to the following criteria.

A: Images are uniform and at a level where no uneven image is recognizable.

B: Images are at a level where uneven images are somewhat recognizable.

C: Images are at a level where uneven images are recognizable.

D: Images are at a level where uneven images are greatly seen.

2) In the image reproduction test, original character images with a 2% duty were reproduced at the end of running, and their image quality was evaluated by visual observation and by observation with a magnifier.

In image reproduction in the HH environment and LL environment, what showed worse changes in image density was taken up to make evaluation according to the following criteria.

A: Images are at a level where any spots around line images and/or blank areas are recognizable.

B: Images are at a level where some spots around line images and/or blank areas are recognizable.

C: Images are at a level where spots around line images and/or blank areas are recognizable.

D: Images are at a level where spots around line images and/or blank areas are greatly seen.

Of the above 1) and 2), worse results were taken as evaluation results.

Examples 22 to 24

Toners 29 to 31 were obtained in the same manner as in Example 21 except that the fine silica powder was changed for the fine silica powders B to D, respectively. Evaluation was also made in the same way as in Example 21 to obtain the results shown in Table 4.

Comparative Example 8

Toner 32 was obtained in the same manner as in Example 21 except that the fine silica powder was changed for the fine silica powder E. Evaluation was also made in the same way as in Example 21 to obtain the results shown in Table 4. As shown by the results, the fog occurred seriously. This is presumed due to the fact that the value of A/B was so small that the fine silica powder came much liberated from the toner and the fine silica powder melt-stuck to the carrier particles in a large quantity and hence the carrier came to have a greatly low charge-providing ability.

Examples 25 to 27

Toners 33 to 35 were obtained in the same manner as in Example 21 except that the fine silica powder was changed for the fine silica powders F to H, respectively. Evaluation was also made in the same way as in Example 21 to obtain the results shown in Table 4.

Comparative Example 9

Toner 36 was obtained in the same manner as in Example 21 except that the fine silica powder was changed for the fine silica powder I. Evaluation was also made in the same way as in Example 21 to obtain the results shown in Table 4. As shown by the results, the image uniformity/image quality was poor. This is presumed due to the fact that the value of A/B was so large that the fine silica powder tended to come buried in toner particles, so that, during long-term service, the toner came to have a greatly poor fluidity and hence any development faithful to electrostatic latent images and any good transfer were performed.

Examples 28 and 29

Toners 37 and 38 were obtained in the same manner as in Example 21 except that the fine silica powder was changed for the fine silica powders J and K, respectively. Evaluation was also made in the same way as in Example 21 to obtain the results shown in Table 4.

Comparative Example 10

Toner 39 was obtained in the same manner as in Example 21 except that the fine silica powder was changed for the fine silica powder L. Evaluation was also made in the same way as in Example 21 to obtain the results shown in Table 4. As shown by the results, the fog occurred seriously. This is presumed due to the fact that the fine silica powder was surface-treated with the silicone oil in so small an amount and had so low a wettability that the fine silica powder was not uniformly surface-treated with the silicone oil, and hence the fine silica powder absorbed moisture greatly in the high-temperature and high-humidity environment to make the toner have a greatly low charge quantity.

Examples 30 and 31

Toners 40 and 41 were obtained in the same manner as in Example 21 except that the fine silica powder was changed for the fine silica powders M and N, respectively. Evaluation was also made in the same way as in Example 21 to obtain the results shown in Table 4.

Comparative Example 11

Toner 42 was obtained in the same manner as in Example 21 except that the fine silica powder was changed for the fine silica powder O. Evaluation was also made in the same way as in Example 21 to obtain the results shown in Table 4. As shown by the results, the fog occurred seriously. This is presumed due to the fact that the fine silica powder was surface-treated with the silicone oil in so large an amount that the toner came to have a greatly poor fluidity.

Examples 32 to 34

Toners 43 to 45 were obtained in the same manner as in Example 21 except that the fine silica powder was changed for the fine silica powders P to R, respectively. Evaluation was also made in the same way as in Example 21 to obtain the results shown in Table 4.

Comparative Example 12

Toner 46 was obtained in the same manner as in Example 21 except that the fine silica powder was changed for the fine silica powder S. Evaluation was also made in the same way as in Example 21 to obtain the results shown in Table 4. As shown by the results, the fog occurred seriously. This is presumed due to the fact that the proportion of from 0.10 μm or more to 1.00 μm or less was so large that composite particles of these came buried in toner particles, so that the toner came to have a greatly poor fluidity.

Examples 35 to 38

Toners 47 to 48 were obtained in the same manner as in Example 21 except that the fine silica powder was changed for the fine silica powders R to U, respectively. Evaluation was also made in the same way as in Example 21 to obtain the results shown in Table 4.

Example 39

Toner 51 was obtained in the same manner as in Example 21 except that the amount of the aqueous 0.1 mol/liter $Na_3PO_4$ solution and the amount of the aqueous 1.0 mol/liter $CaCl_2$ solution were changed to 51.8 parts by mass and 70.5 parts by mass, respectively. Evaluation was also made in the same way as in Example 21 to obtain the results shown in Table 4.

Comparative Example 13

Toner 52 was obtained in the same manner as in Example 21 except that the amount of the aqueous 0.1 mol/liter $Na_3PO_4$ solution and the amount of the aqueous 1.0 mol/liter $CaCl_2$ solution were changed to 52.6 parts by mass and 70.8 parts by mass, respectively. Evaluation was also made in the same way as in Example 21 to obtain the results shown in Table 4. As shown by the results, the fog occurred seriously. This is presumed due to the fact that, even in a toner in which the fine silica powder used in the present invention was externally added, the toner was so large in particle diameter as to be difficult for itself to perform development faithfully to electrostatic latent images and also that the toner tended to scatter when transferred electrostatically.

Example 40

Toner 53 was obtained in the same manner as in Example 21 except that the amount of the aqueous 0.1 mol/liter $Na_3PO_4$ solution and the amount of the aqueous 1.0 mol/liter $CaCl_2$ solution were changed to 38.3 parts by mass and 67.9 parts by mass, respectively. Evaluation was also made in the same way as in Example 21 to obtain the results shown in Table 4.

Comparative Example 14

Toner 54 was obtained in the same manner as in Example 21 except that the amount of the aqueous 0.1 mol/liter $Na_3PO_4$ solution and the amount of the aqueous 1.0 mol/liter $CaCl_2$ solution were changed to 36.9 parts by mass and 67.8 parts by mass, respectively. Evaluation was also made in the same way as in Example 21 to obtain the results shown in Table 4. As shown by the results, the image uniformity/image quality was poor. This is presumed due to the fact that the toner was so small in particle diameter as to be difficult for itself to perform development faithfully to electrostatic latent images and also that the toner tended to scatter when transferred electrostatically.

TABLE 4

| | Toner | Change in image density | Fog | Image uniformity, image quality |
|---|---|---|---|---|
| Ex. 21 | Toner 28 | A | A | A |
| Ex. 22 | Toner 29 | A | A | A |
| Ex. 23 | Toner 30 | B | B | B |
| Ex. 24 | Toner 31 | B | B | C |
| Cp. 8 | Toner 32 | C | E | D |
| Ex. 25 | Toner 33 | A | A | A |
| Ex. 26 | Toner 34 | A | A | A |
| Ex. 27 | Toner 35 | B | C | C |
| Cp. 9 | Toner 36 | B | D | D |
| Ex. 28 | Toner 37 | A | A | A |
| Ex. 29 | Toner 38 | A | B | B |
| Cp. 10 | Toner 39 | C | D | C |
| Ex. 30 | Toner 40 | A | A | A |
| Ex. 31 | Toner 41 | B | C | B |
| Cp. 11 | Toner 42 | B | E | C |
| Ex. 32 | Toner 43 | A | A | A |
| Ex. 33 | Toner 44 | B | B | B |
| Ex. 34 | Toner 45 | B | C | B |
| Cp. 12 | Toner 46 | C | E | C |
| Ex. 35 | Toner 47 | B | B | B |
| Ex. 36 | Toner 48 | B | C | B |
| Ex. 37 | Toner 49 | B | B | B |
| Ex. 38 | Toner 50 | B | C | B |
| Ex. 39 | Toner 51 | B | C | B |
| Cp. 13 | Toner 52 | C | D | D |
| Ex. 40 | Toner 53 | A | B | B |
| Cp. 14 | Toner 54 | B | C | D |

Ex.: Example
Cp.: Comparative Example

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-091160, filed on Mar. 31, 2008, which is herein incorporated by reference as part of this application.

What is claimed is:

1. A toner which comprises toner particles and at least a fine silica powder having been mixed by external addition to the toner particles;

the toner having a weight average particle diameter of from 4.0 μm or more to 9.0 μm or less, and;

the fine silica powder having been subjected to hydrophobic treatment with dimethylsilicone oil at least, and having, in particle size distribution based on volume of the fine silica powder as measured with a laser diffraction particle size distribution meter, a peak at which cumulative frequency is largest, in at least the measurement range of from 0.02 μm or more to 1,000.00 μm or less; the cumulative frequency of from 0.10 μm or more to less than 1.00 μm being 7.0% or less, and, where the cumulative frequency of from 10.10 μm or more to less than 39.23 μm is represented by A(%) and the cumulative frequency of from 39.23 μm or more to less than 200.00 μm is represented by B(%), the fine silica powder fulfilling the following conditions 1) to 3):

1) $A+B \geqq 93.0$;

2) $0.45 \leqq A/B \leqq 6.00$; and 3) the value of [(carbon content of the treated fine silica powder)/(BET specific surface area of fine silica powder before hydrophobic treatment)] is from 0.030 or more to 0.055 or less.

2. The toner according to claim 1, wherein the fine silica powder fulfills the condition: $0.50 \leqq A/B \leqq 3.50$.

3. The toner according to claim 1, wherein the fine silica powder is 2.5% or more in cumulative frequency of from 77.34 μm or more to less than 200.00 μm.

4. The toner according to claim 1, wherein the fine silica powder is 5.0% or less in the cumulative frequency of from 0.10 μm or more to less than 1.00 μm.

5. The toner according to claim 1, wherein the fine silica powder is from 0.035 or more to 0.050 or less in the value of [(carbon content of the treated fine silica powder)/(BET specific surface area of fine silica powder before hydrophobic treatment)].

6. The toner according to claim 1, wherein the fine silica powder has a BET specific surface area of from 35 $m^2/g$ or more to 350 $m^2/g$ or less.

7. The toner according to claim 1, which has an average circularity R of $0.960 \leqq R \leqq 0.995$ as measured with a flow type particle image analyzer.

8. The toner according to claim 1, wherein the toner particles are toner particles produced by dispersing a polymerizable monomer composition containing at least a polymerizable monomer, a colorant, a polar resin, a release agent and a polymerization initiator, in an aqueous medium to carry out granulation, and polymerizing the polymerizable monomer composition.

9. The toner according to claim 1, wherein the fine silica powder has a wettability to a methanol/water mixed solvent, of from 70% by volume or more to 75% by volume or less at a point of time where the transmittance of light at 780 nm in wavelength is 50%.

10. An image forming method which comprises a charging means which charges the surface of an image bearing member electrostatically, an information writing means which forms an electrostatic latent image on the image bearing member, a developing means which renders the electrostatic latent image visible by the use of a toner to form a toner image, and a transfer means which transfers the toner image to a transfer material via, or not via, an intermediate transfer member;

the toner comprising toner particles and at least a fine silica powder having been mixed by external addition to the toner particles;

the toner being the toner according to claim 1.

* * * * *